US009739111B2

(12) United States Patent
Beason et al.

(10) Patent No.: US 9,739,111 B2
(45) Date of Patent: Aug. 22, 2017

(54) CONTROLLED APERTURE BALL DROP

(71) Applicant: Oil States Energy Services, L.L.C., Houston, TX (US)

(72) Inventors: Ronald B. Beason, Wanette, OK (US); Nicholas J. Cannon, Washington, OK (US)

(73) Assignee: OIL STATES ENERGY SERVICES, L.L.C., Houston, TX (US)

( * ) Notice: Subject to any disclaimer, the term of this patent is extended or adjusted under 35 U.S.C. 154(b) by 590 days.

(21) Appl. No.: 14/278,328

(22) Filed: May 15, 2014

(65) Prior Publication Data

US 2014/0246189 A1 Sep. 4, 2014

Related U.S. Application Data

(63) Continuation-in-part of application No. 14/105,688, filed on Dec. 13, 2013, now Pat. No. 8,839,851, which is a continuation of application No. 13/101,805, filed on May 5, 2011, now Pat. No. 8,636,055.

(51) Int. Cl.
*E21B 33/068* (2006.01)

(52) U.S. Cl.
CPC ..... *E21B 33/068* (2013.01)

(58) Field of Classification Search
CPC ..... E21B 33/068; F16F 55/46
USPC ..... 166/75.15; 15/104.062
See application file for complete search history.

(56) References Cited

U.S. PATENT DOCUMENTS

| | | | |
|---|---|---|---|
| 2,961,045 | A | 11/1960 | Stonger et al. |
| 2,961,046 | A | 11/1960 | Moeller et al. |
| 3,664,356 | A | 5/1972 | Grove et al. |
| 3,779,270 | A | 12/1973 | Davis |
| 3,889,708 | A | 6/1975 | Chronister et al. |
| 4,111,334 | A | 9/1978 | Winn et al. |
| 4,132,243 | A | 1/1979 | Kuus |
| 4,199,834 | A | 4/1980 | Muchow et al. |
| 4,268,932 | A | 5/1981 | Hogan |
| 4,359,797 | A | 11/1982 | Banks |
| 6,302,199 | B1 | 10/2001 | Hawkins et al. |
| 6,575,238 | B1 | 6/2003 | Yokley |
| 8,636,055 | B2 | 1/2014 | Young et al. |

(Continued)

FOREIGN PATENT DOCUMENTS

| | | |
|---|---|---|
| CN | 201650255 U | 11/2010 |
| CN | 103498657 | 1/2014 |

OTHER PUBLICATIONS

Office Action dated Dec. 21, 2015 for Canadian Patent Application No. 2,871,203.

(Continued)

*Primary Examiner* — Giovanna C Wright
(74) *Attorney, Agent, or Firm* — Nelson Mullins Riley & Scarborough, LLP

(57) ABSTRACT

A controlled aperture ball drop includes a ball cartridge that is mounted to a frac head or a high pressure fluid conduit. The ball cartridge houses a ball rail having a bottom end that forms an aperture with an inner periphery of the ball cartridge through which frac balls of a frac ball stack supported by the ball rail are sequentially dropped from the frac ball stack as a size of the aperture is increased by an aperture controller operatively connected to the ball rail. A control console displays a user interface that permits an operator to control the controlled aperture ball drop to drop frac balls only when desired.

20 Claims, 28 Drawing Sheets

(56) References Cited

U.S. PATENT DOCUMENTS

| | | | |
|---|---|---|---|
| 8,839,851 | B2 | 9/2014 | Young et al. |
| 2003/0155114 | A1 | 8/2003 | Pedersen et al. |
| 2003/0164237 | A1 | 9/2003 | Butterfield |
| 2005/0039925 | A1 | 2/2005 | Connel |
| 2005/0184083 | A1 | 8/2005 | Diaz et al. |
| 2007/0068679 | A1 | 3/2007 | Robichaux et al. |
| 2008/0087414 | A1 | 4/2008 | Robichaux et al. |
| 2008/0223587 | A1 | 9/2008 | Cherewyk |
| 2010/0200222 | A1 | 8/2010 | Robichaux et al. |
| 2010/0288496 | A1 | 11/2010 | Cherewyk |

OTHER PUBLICATIONS

Non-Final Office Action for U.S. Appl. No. 14/487,211 dated Jan. 27, 2017.

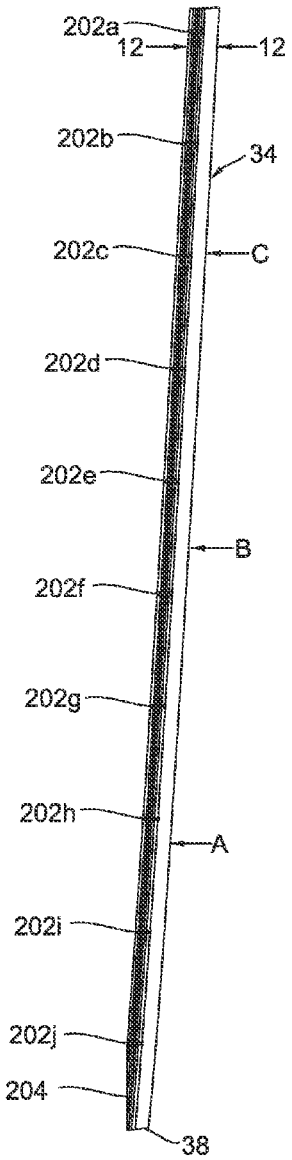
FIG. 11
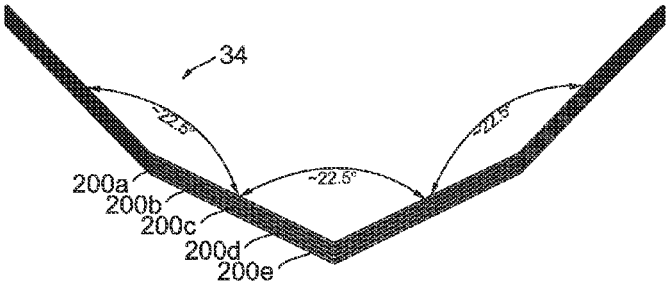
FIG. 12
| Rail Deflection Under 10 lb. Mass | | | |
|---|---|---|---|
| Position | (A) 17.75" | (B) 35.50" | (C) 53.25" |
| Deflection | 0.040" | 0.060" | 0.045" |
FIG. 13

CONTROLLED APERTURE BALL DROP

RELATED APPLICATIONS

This application is a continuations-in-part of U.S. patent application Ser. No. 14/105,688 filed Dec. 13, 2013; which is a continuation of U.S. patent application Ser. No. 13/101,805 filed May 5, 2011, that issued on Jan. 28, 2014 as U.S. Pat. No. 8,636,055, the specifications of which are respectively incorporated herein by reference.

FIELD OF THE INVENTION

This invention relates in general to equipment used for the purpose of well completion, re-completion or workover, and, in particular, to equipment used to drop frac balls into a fluid stream pumped into a subterranean well during well completion, re-completion or workover operations.

BACKGROUND OF THE INVENTION

The use of frac balls to control fluid flow in a subterranean well is known, but of emerging importance in well completion operations. The frac balls are generally dropped or injected into a well stimulation fluid stream being pumped into the well. This can be accomplished manually, but the manual process is time consuming and requires that workmen be in close proximity to highly pressurized frac fluid lines, which is a safety hazard. Consequently, frac ball drops and frac ball injectors have been invented to permit faster and safer operation.

Multi-stage well stimulation operations often require that frac balls be sequentially pumped into the well in a predetermined size order that is graduated from a smallest to a largest frac ball. Although there are frac ball injectors that can be used to accomplish this, they operate on a principle of selecting one of several injectors at the proper time to inject the right ball into the well when required. A frac ball can therefore be dropped out of the proper sequence, which has undesired consequences.

As well understood by those skilled in the art, ball drops must also operate reliably in a harsh environment where they are subjected to extreme temperatures, abrasive dust, internal pressure surges, high frequency vibrations, and inclement weather effects including rain, ice and snow.

There therefore exists a need for a controlled aperture ball drop for use during well completion, re-completion or workover operations that substantially eliminates the possibility of dropping a frac ball into a subterranean well out of sequence and that ensures reliable operation in a harsh operating environment.

SUMMARY OF THE INVENTION

It is therefore an object of the invention to provide a controlled aperture ball drop for use during multi-stage well completion, re-completion or workover operations.

The invention therefore provides a controlled aperture ball drop, comprising: a ball cartridge having a top end and a bottom end adapted to be sealed by a threaded top cap and a bottom end adapted to the connected to a frac head or a high pressure fluid conduit; a ball rail within the ball cartridge that supports a frac ball stack arranged in a predetermined size sequence against an inner periphery of the ball cartridge; and an aperture controller operatively connected to the ball rail in the ball cartridge, the aperture controller controlling a size of a ball drop aperture between an inner periphery of the ball cartridge and a bottom end of the ball rail to sequentially release frac balls from the frac ball stack.

The invention further provides a controlled aperture ball drop, comprising: a ball rail within a ball cartridge, the ball rail supporting a frac ball stack arranged in a predetermined size sequence against an inner periphery of the ball cartridge; and an aperture controller operatively connected to the ball rail, the aperture controller controlling a size of an aperture between a bottom end of the ball rail and an inner periphery of the ball cartridge to sequentially drop frac balls from the frac ball stack.

The invention yet further provides a controlled aperture ball drop, comprising a ball rail supported within a ball cartridge adapted to be mounted to a frac head or a high pressure fluid conduit, the ball rail supporting a frac ball stack arranged in a predetermined size sequence against an inner periphery of the ball cartridge, and an aperture controller operatively connected to the ball rail, the aperture controller controlling a size of an aperture between a bottom end of the ball rail and an inner periphery of the ball cartridge to sequentially release frac balls from the frac ball stack.

BRIEF DESCRIPTION OF THE DRAWINGS

Having thus generally described the nature of the invention, reference will now be made to the accompanying drawings, in which:

FIG. 11 is a side elevational view of one embodiment of a ball rail for the embodiments of the invention shown in FIGS. 1-10;

FIG. 12 is a schematic cross-sectional view of the ball rail shown in FIG. 11, taken at lines 12-12 of FIG. 11;

FIG. 13 is a table showing a deflection of the ball rail shown in FIG. 11 at points A, B and C under a 10 lb. (4.54 kg) mass;

DETAILED DESCRIPTION OF THE PREFERRED EMBODIMENTS

The invention provides a controlled aperture ball drop adapted to drop a series of frac balls arranged in a predetermined size sequence into a fluid stream being pumped into a subterranean well. The frac balls are stored in a large capacity ball cartridge of the ball drop, which ensures that an adequate supply of frac balls is available for complex well completion projects. The frac balls are aligned in the predetermined size sequence and kept in that sequence by a ball rail supported within the ball cartridge by an aperture control arm. An aperture controller moves the aperture control arm in response to a drop ball command to release a next one of the frac balls in the frac ball sequence into the fluid stream being pumped into the subterranean well. In one embodiment the ball drop includes equipment to detect a ball drop and confirm that a ball has been released from the ball cartridge.

Figure 1:
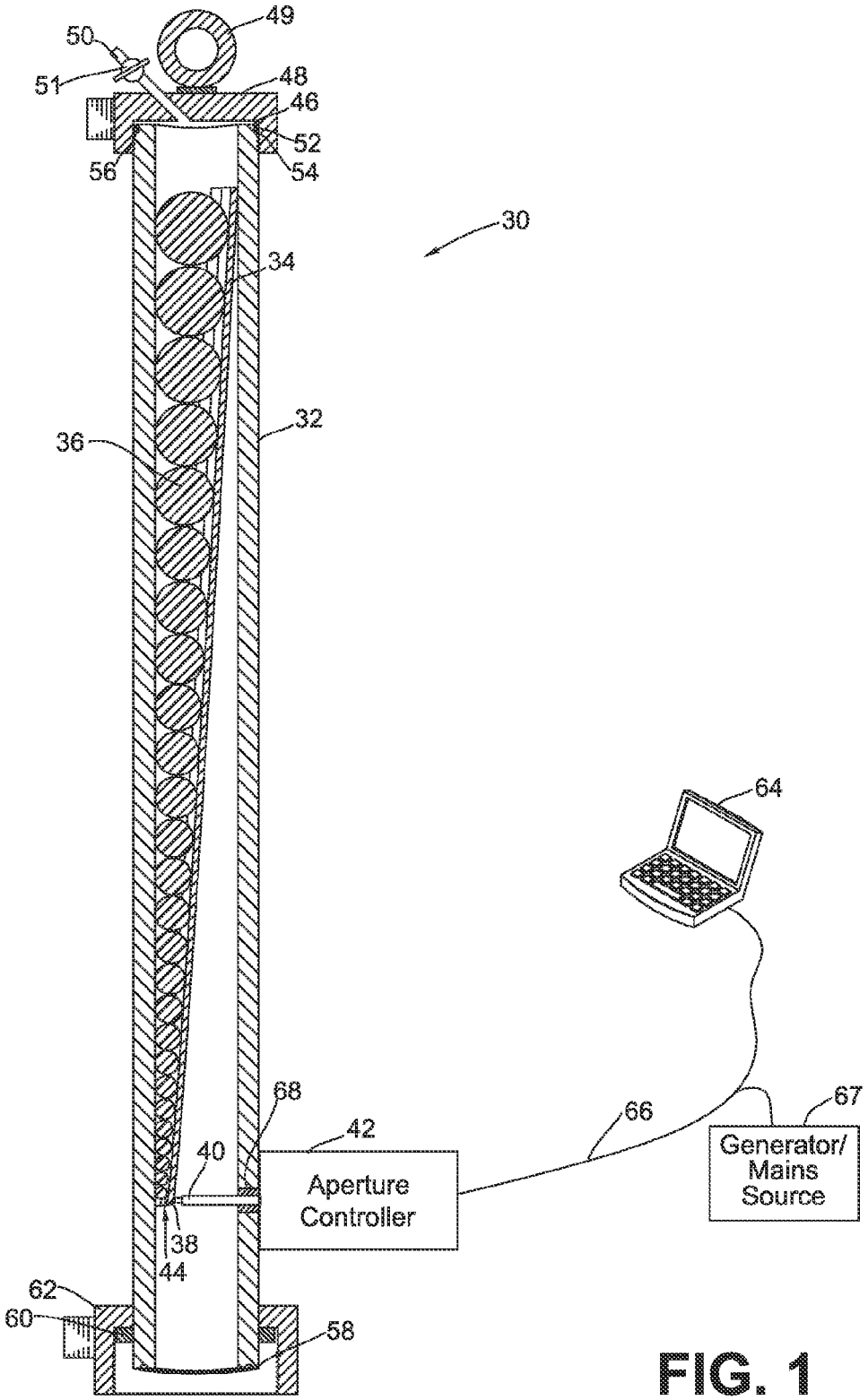
FIG. 1 is a schematic cross-sectional view of one embodiment of the controlled aperture ball drop in accordance with the invention.

FIG. 1 is a schematic cross-sectional view of one embodiment of a controlled aperture ball drop 30 in accordance with the invention. A cylindrical ball cartridge 32 accommodates a ball rail 34 that supports a plurality of frac balls 36 arranged in a predetermined size sequence in which the frac balls are to be dropped from the ball drop 30. In one embodiment the ball cartridge 32 is made of a copper beryllium alloy, which is nonmagnetic and has a very high tensile strength. However, the ball cartridge 32 may also be made of stainless steel, provided the material used has enough tensile strength to contain fluid pressures that will be used to inject stimulation fluid into the well (generally, up to around 20,000 psi). The ball rail 34 is supported at a bottom end 38 by an aperture control arm 40 that extends through a port in a sidewall of the ball cartridge 32 and is operatively connected to an aperture controller 42. The aperture controller 42 incrementally moves the aperture control arm 40 to control a size of a ball drop aperture 44 between an inner periphery of the ball cartridge 32 and the bottom end 38 of the ball rail 34. Exemplary embodiments of the aperture controller 42 will be described below in detail with reference to FIGS. 2-4. However, it should be understood that the aperture controller 42 may be implemented using any one of: an alternating current (AC) or direct current (DC) electric motor; an AC or DC stepper motor; an AC of DC variable frequency drive; an AC or DC servo motor without a mechanical rotation stop; a pneumatic motor; a hydraulic motor; or, a manual crank.

A top end 46 of the ball cartridge 32 is sealed by a threaded top cap 48. In one embodiment the top cap 48 is provided with a lifting eye 49, and a vent tube 50 that is sealed by a high pressure needle valve 51. The high pressure needle valve 51 is used to vent air from the ball cartridge 32 before a frac job is commenced, using procedures that are well understood in the art. A high pressure seal is provided between the ball cartridge 32 and the top cap 48 by one or more high pressure seals 52. In one embodiment, the high pressure seals 52 are O-rings with backups 54 that are received in one or more circumferential seal grooves 56 in the top end 46 of the ball cartridge 32. In one embodiment, a bottom end 58 of the ball cartridge 32 includes a radial shoulder 60 that supports a threaded nut 62 for connecting the ball drop 30 to a frac head or a high pressure fluid conduit using a threaded union as described in Assignee's U.S. Pat. No. 7,484,776, the specification of which is incorporated herein by reference. As will be understood by those skilled in the art, the bottom end 58 may also terminate in an API (American Petroleum Institute) stud pad or an API flange, both of which are well known in the art.

Movement of the aperture control arm 40 by the aperture controller 42 to drop a frac ball 36 from the ball cartridge 32, or to return to a home position in which the bottom end 38 of the ball rail 34 contacts the inner periphery of the ball cartridge 32, may be remotely controlled by a control console 64. In one embodiment, the control console 64 is a personal computer, though a dedicated control console 64 may also be used. The control console 64 is connected to the aperture controller 42 by a control/power umbilical 66 used to transmit control signals to the aperture controller 42, and receive status information from the aperture controller 42. The control/power umbilical 66 is also used to supply operating power to the aperture controller 42. The control/power umbilical 66 supplies operating power to the aperture controller 42 from an onsite generator or mains power source 67. The aperture controller 42 is mounted to an outer sidewall of the ball cartridge 32 and reciprocates the aperture control arm 40 through a high pressure fluid seal 68. In one embodiment the high pressure fluid seal 68 is made up of one or more high pressure lip seals, well known in the art. Alternatively, the high pressure fluid seal 68 may be two or more O-rings with backups, chevron packing, one or more PolyPaks®, or any other high pressure fluid seal capable of ensuring that highly pressurized well stimulation fluid will not leak around the aperture control arm 40.

Figure 2:
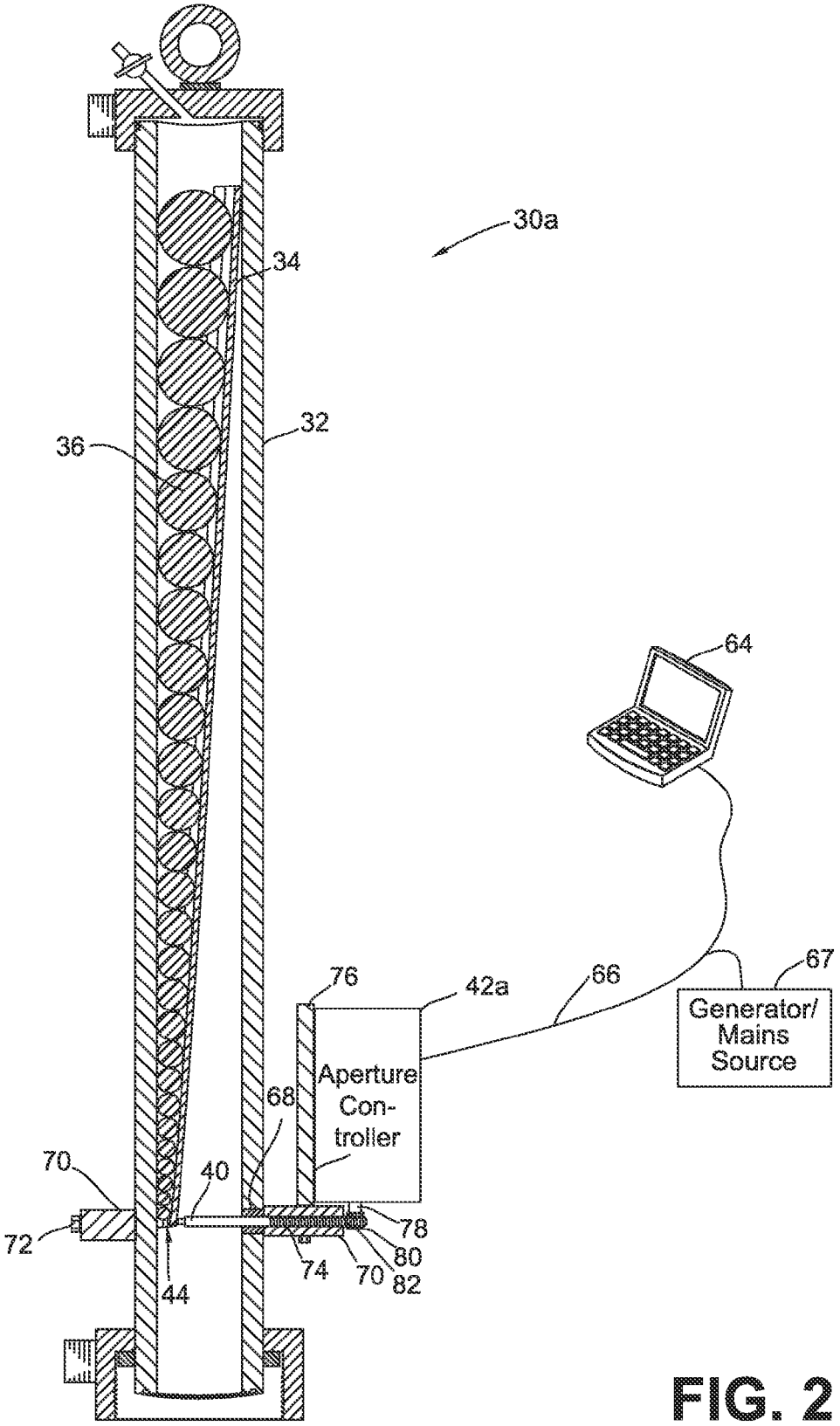
FIG. 2 is a schematic cross-sectional view of another embodiment of the controlled aperture ball drop in accordance with the invention.

FIG. 2 is a schematic cross-sectional view of another embodiment of a controlled aperture ball drop 30*a* in accordance with the invention. In this embodiment the aperture controller 42*a* is mounted to a radial clamp 70 secured around a periphery of the ball cartridge 32 by, for example, two or more bolts 72. A bore 74 through the radial clamp 70 accommodates the aperture control arm 40. The aperture controller 42*a* is mounted to a support plate 76 that is bolted, welded, or otherwise affixed to the radial clamp 70. The aperture controller 42*a* has a drive shaft 78 with a pinion gear 80 that meshes with a spiral thread 82 on the aperture control arm 40. Rotation of the drive shaft 78 in one direction induces linear movement of the aperture control arm 40 to reduce a size of the ball drop aperture 44, while rotation of the drive shaft 78 in the opposite direction induces linear movement of the aperture control arm 40 in the opposite direction to increase a size of the ball drop aperture 44. The unthreaded end of the aperture control arm 40 is a chrome shaft, which is well known in the art.

Figure 3:
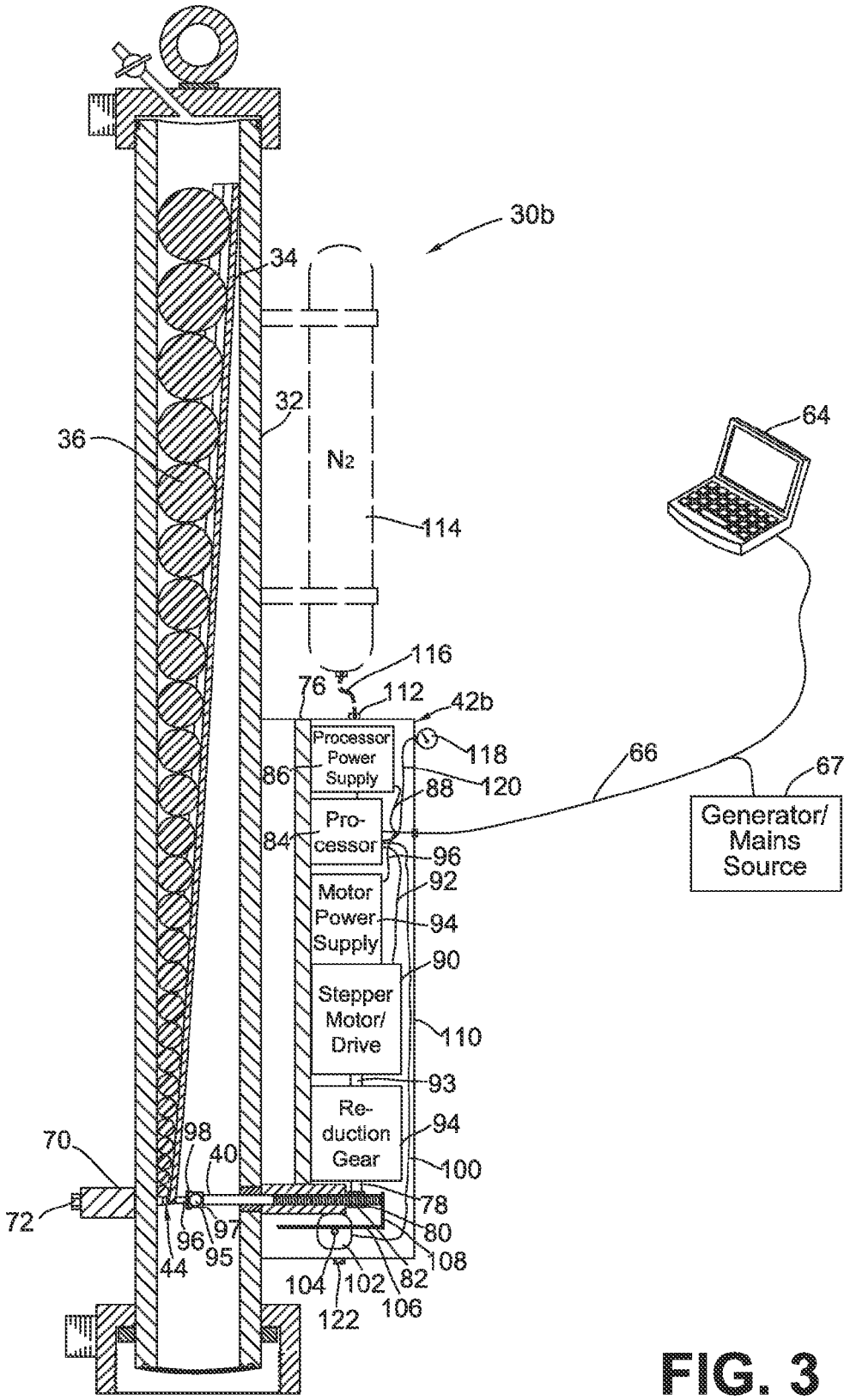
FIG. 3 is a schematic cross-sectional view of one embodiment of the controlled aperture ball drop showing one embodiment of an aperture controller in accordance with the invention.

FIG. 3 is a schematic cross-sectional view of an embodiment of a controlled aperture ball drop 30*b* showing an aperture controller 42*b* in accordance with one embodiment of the invention. In this embodiment the aperture controller 42*b* has an onboard processor 84 that receives operating power from an onboard processor power supply 86. Electrical power is supplied to the processor power supply 86 by the onsite generator or mains source 67 via an electrical feed 88 incorporated in the control/power umbilical 66. The processor 84 sends a TTL (Transistor-Transistor Logic) pulse for each step to be made by a stepper motor/drive 90, as well as a TTL direction line to indicate a direction of rotation of the step(s), to the stepper motor/drive unit 90 via a control connection 92. The TTL pulses control rotation of the pinion gear 80 in response to commands received from the control console 64. The stepper motor/drive unit 90 is supplied with operating power by a motor power supply 94 that is in turn supplied with electrical power via an electrical feed 96 incorporated into the control/power umbilical 66. In one embodiment, the motor power supply 94 and the stepper motor/drive 90 are integrated in a unit available from Schneider Electric Motion USA as the MDrive®34AC.

An output shaft 93 of the stepper motor/drive 90 is connected to an input of a reduction gear 94 to provide fine control of the linear motion of the control arm 40. The reduction ratio of the reduction gear 94 is dependent on the operating characteristics of the stepper motor/drive 90, and a matter of design choice. The output of the reduction gear 94 is the drive shaft 78 that supports the pinion gear 80 described above. In this embodiment, the aperture control arm 40 is connected to the bottom end of the ball rail 34 by a ball and socket connection. A ball 95 is affixed to a shaft 96 that is welded or otherwise affixed to the bottom end of the ball rail 34. The ball 95 is captured in a socket 97 affixed to an inner end of the aperture control arm 40. A cap 98 is affixed to the open end of the socket 97 to trap the ball 95 in the socket 97. It should be understood that the aperture control arm 40 may be connected to the ball rail 40 using other types of secure connectors know in the art.

An absolute position of the aperture control arm 40 is provided to the processor 84 via a signal line 100 connected to an absolute encoder 102. A pinion affixed to an axle 104 of the absolute encoder 102 is rotated by a rack 106 supported by a plate 108 connected to an outer end of the aperture control arm 40. In one embodiment, the absolute encoder 102 outputs to the processor 84 a 15-bit code word via the signal line 100. The processor 84 translates the 15-bit code word into an absolute position of the aperture control arm 40 with respect to the home position in which the bottom end 38 of the ball rail 34 contacts the inner periphery of the ball cartridge 32.

Since the ball drop 30*b* is designed to operate in an environment where gaseous hydrocarbons may be present, the aperture controller 42*b* is preferably encased in an aperture controller capsule 110. In one embodiment the capsule 110 is hermetically sealed and charged with an inert gas such as nitrogen gas ($N_2$). The capsule 110 may be charged with inert gas in any one of several ways. In one embodiment, N2 is periodically injected through a port 112 in the capsule 110. In another embodiment, the capsule 110 is charged with inert gas supplied by an inert gas cylinder 114 supported by the ball cartridge 32. A hose 116 connects the inert gas cylinder 114 to the port 112. The capsule 110 may be provided with a bleed port 122 that permits the inert gas to bleed at a controlled rate from the capsule 110. This permits a temperature within the capsule to be controlled when operating in a very hot environment since expansion of the inert gas as it enters the capsule 110 provides a cooling effect. Gas pressure within the capsule 110 may be monitored by the processor 84 using a pressure probe (not shown) and reported to the control console 64. Alternatively, and/or in addition, the internal pressure in the capsule 110 may be displayed by a pressure gauge 118 that measures the capsule pressure directly or displays a digital pressure reading obtained from the processor 84 via a signal line 120.

Figure 4:
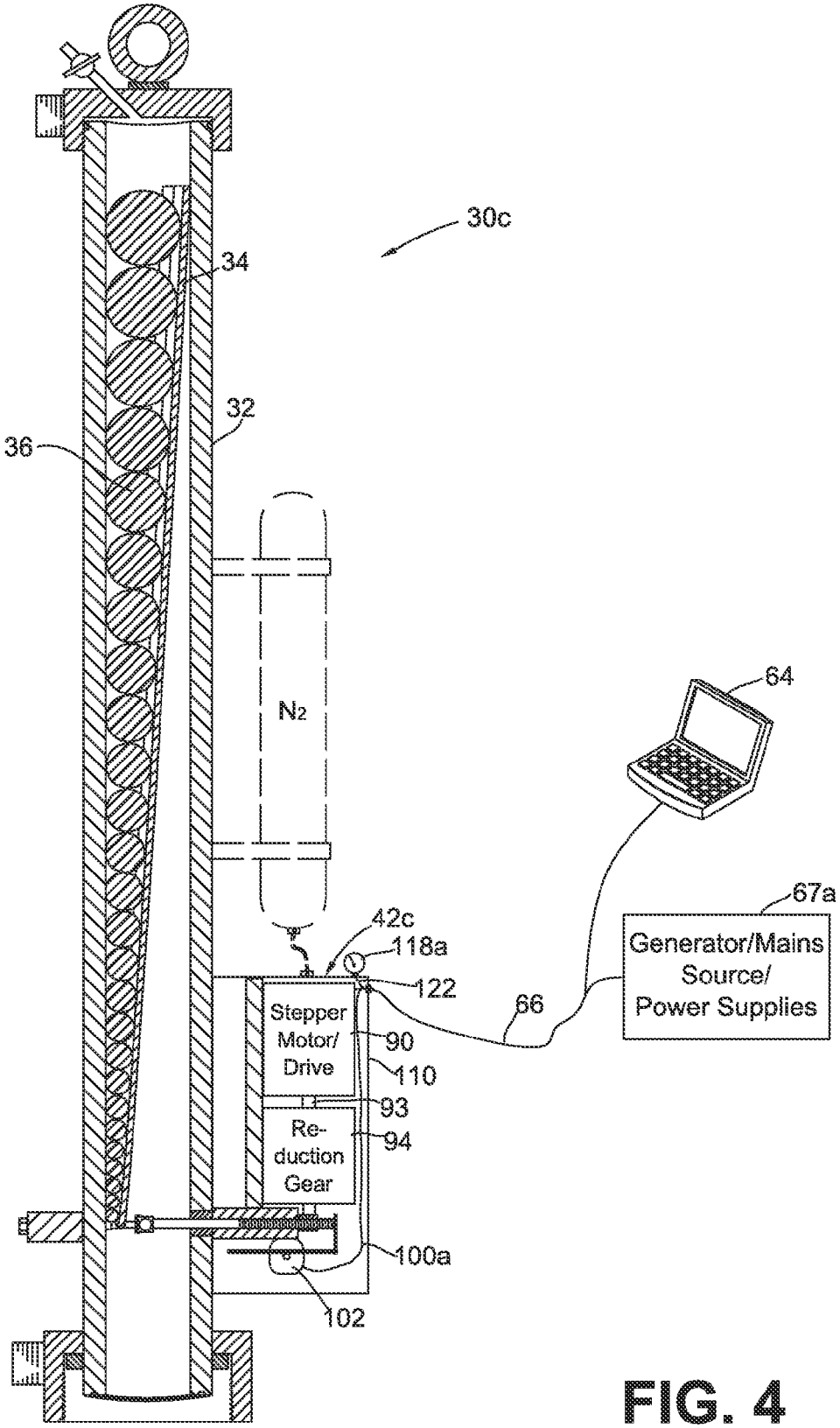
FIG. 4 is a schematic cross-sectional view of yet another embodiment of the controlled aperture ball drop in accordance with the invention.

FIG. 4 is a schematic cross-sectional view of yet another embodiment of a controlled aperture ball drop 30*c* in accordance with the invention. This embodiment of is similar to the controlled aperture ball drop 30*b* described above with reference to FIG. 3, except that all control and reckoning functions are performed by the control console 64, and power supply for the stepper motor/drive unit 90 is either integral with the unit 90 or housed with a generator/mains source/power supplies 67*a*. Consequently, the control console 64 sends TTL pulses and TTL direction lines directly via the control/power umbilical 66 to the stepper motor/drive unit 90 of an aperture controller 42*b* to control movement of the aperture control arm 40. An absolute position of the aperture control arm 40 is reported to the control console 64 by the absolute encoder 102 via a signal line 100*a* in the control/power umbilical 66. An internal pressure of the capsule 110 is measured by a pressure sensor 118*a*, and reported to the control console 64 via a signal line 122 incorporated into the control/power umbilical 66. The pressure sensor 118*a* optionally also provides a direct optical display of gas pressure within the capsule 110.

Figure 5:
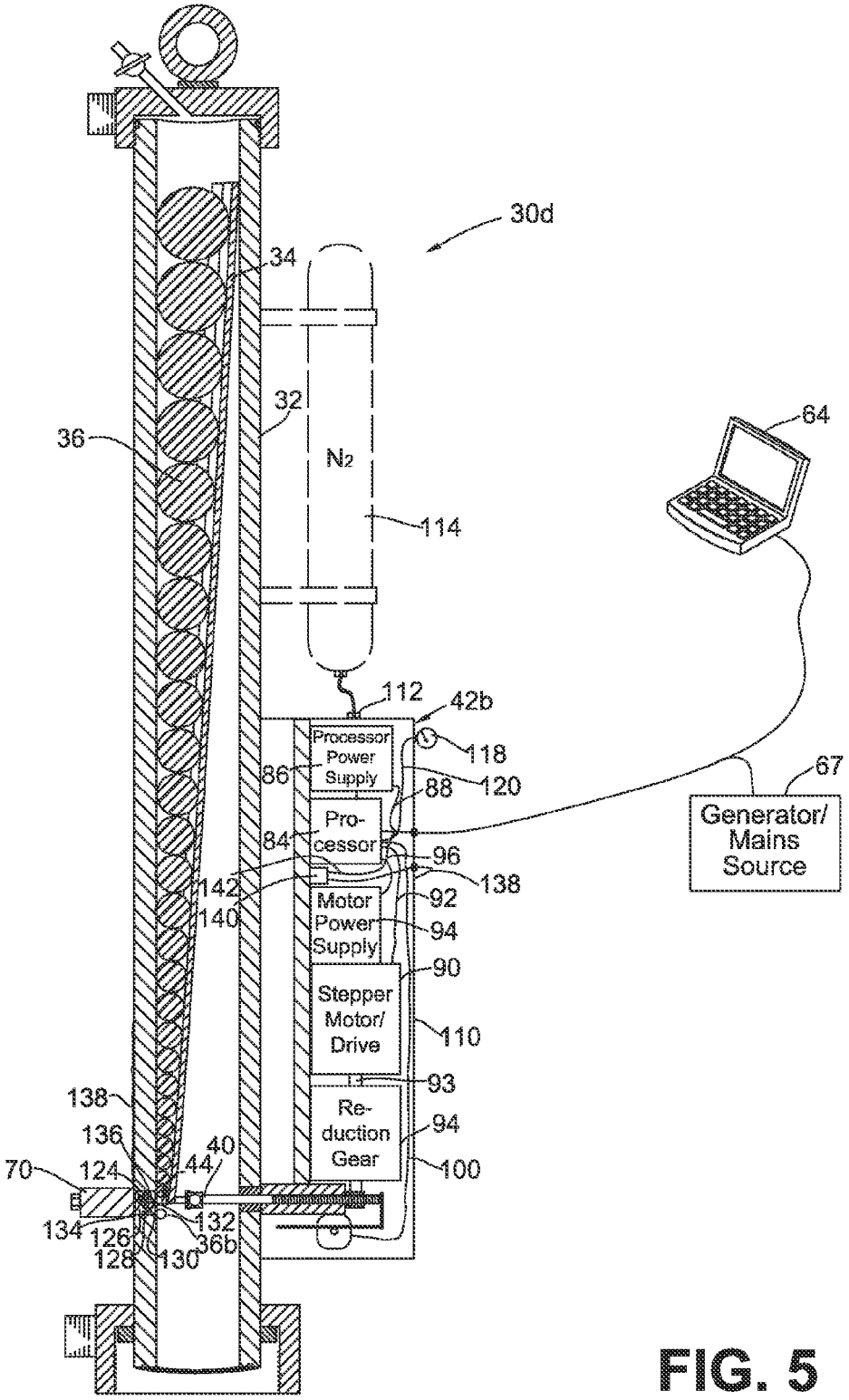
FIG. 5 is a schematic cross-sectional view of a further embodiment of the controlled aperture ball drop in accordance with the invention.

FIG. 5 is a schematic cross-sectional view of a further embodiment of a controlled aperture ball drop 30*d* in accordance with the invention. The ball drop 30*d* is the same as the ball drop 30*b* described above with reference to FIG. 3 except that it further includes an optical detector for detecting each ball dropped by the ball drop 30*d*. In this embodiment, the optical detector is implemented using a port 124 in a sidewall of the ball cartridge 32 opposite the port that accommodates the aperture control arm 40. The port 124 receives a copper beryllium plug 126 that is retained in the port 124 by the radial clamp 70. A high pressure fluid seal is provided by, for example, one or more O-ring seals with backups 128 received in peripheral grooves in the plug 126. An angled, stepped bore 130 in the plug 126 receives a collet 132 with an axial, stepped bore 134. An inner end of the axial stepped bore 134 retains a sapphire window 136. Two optical fibers sheathed in a cable 138 are glued to an inner side of the sapphire window 136 using, for example, an optical grade epoxy. One of the optical fibers emits light generated by a photoelectric sensor 140 housed in the aperture controller capsule 110. In one embodiment, the photoelectric sensor 140 is a Banner Engineering SM312FP. When a ball 36*b* is dropped by the controlled aperture ball drop 30*d*, the light emitted by the one optical fiber is reflected back to the other optical fiber, which transmits the light to the photoelectric sensor 140. The photoelectric sensor 140 generates a signal in response to the reflected light and transmits the signal to the processor 84 via a signal line 142. The processor 84 translates the signal and notifies the control console 64 of the ball drop.

Figure 6:
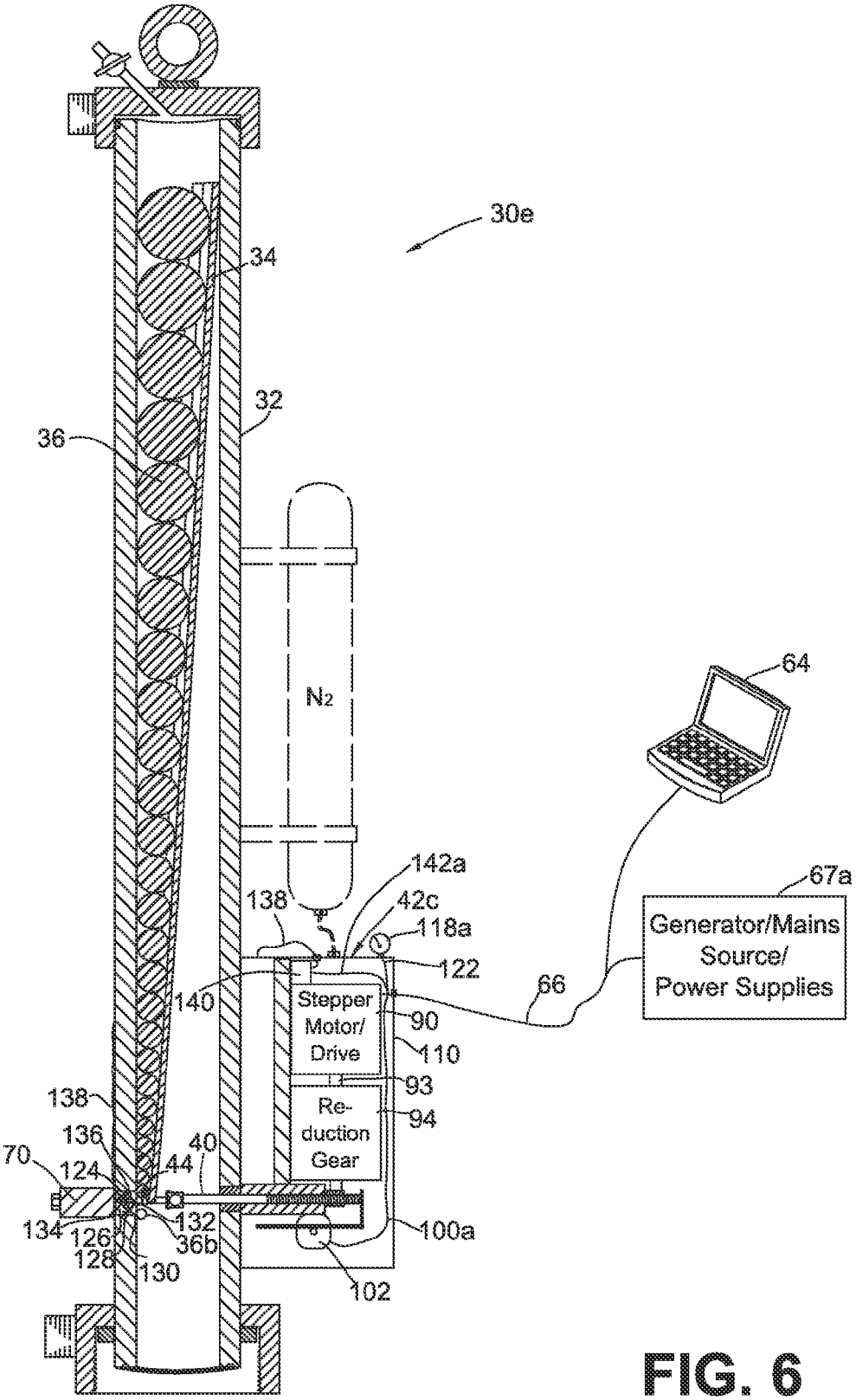
FIG. 6 is a schematic cross-sectional view of yet a further embodiment of the controlled aperture ball drop in accordance with the invention.

FIG. 6 is a schematic cross-sectional view of yet a further embodiment of a controlled aperture ball drop 30*e* in accordance with the invention. This embodiment is the same as the controlled aperture ball drop 30*c* described above with reference to FIG. 4 except that it further includes the photo detector described above with reference to FIG. 5, which will not be redundantly described. In this embodiment, however, the signal generated by the photoelectric sensor 140 is sent via a signal line 142*a* incorporated in the control/power umbilical 66 to the control console 64. The control console 64 processes the signals generated by the photoelectric sensor 140 to confirm a ball drop.

Figure 7:
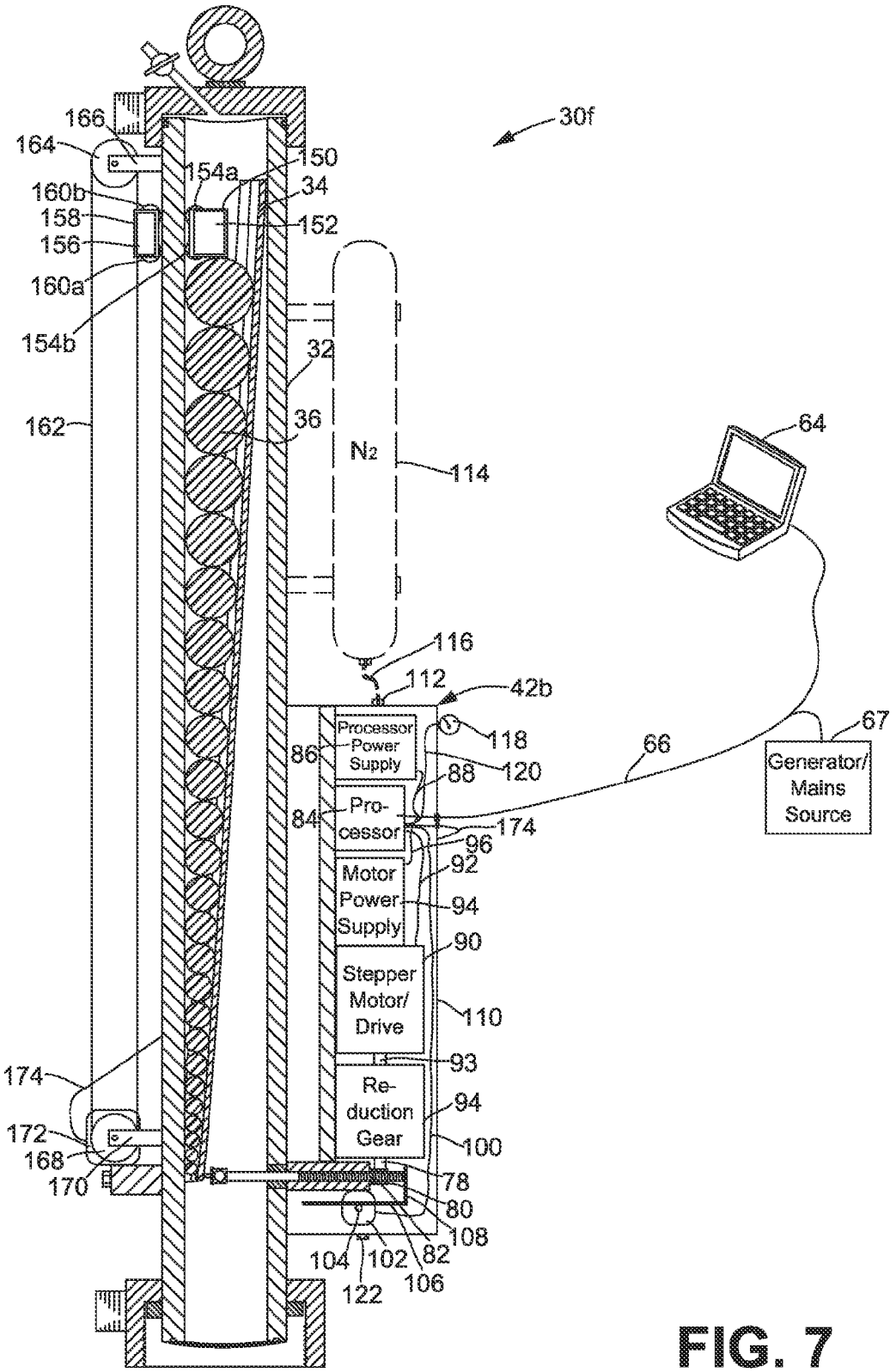
FIG. 7 is a schematic cross-sectional view of still a further embodiment of the controlled aperture ball drop in accordance with the invention.

FIG. 7 is a schematic cross-sectional view of still a further embodiment of a controlled aperture ball drop 30*f* in accordance with the invention. This embodiment is the same as the embodiment described above with reference to FIG. 3 except that it includes a mechanism for tracking a height of the ball stack 36 supported by the ball rail 34, to permit the operator to verify that a frac ball has been dropped when a ball drop command is sent from the control console 64. In this embodiment, a ball stack follower 150 rests on top of the frac ball stack 36. The ball stack follower 150 encases one or more rare earth magnets 152. The ball stack follower 150 has two pairs of wheels 154*a* and 154*b* that space it from the inner periphery of the ball cartridge 32 to reduce friction and ensure that the ball stack follower readily moves downwardly with the ball stack 36 as frac balls are dropped by the ball drop 30*f*. The rare earth magnet(s) 152 strongly attracts oppositely oriented rare earth magnet(s) 156 carried by an external ball stack tracker 158. The ball stack tracker 158 also has two pairs of wheels 160*a* and 160*b* that run over the outer sidewall of the ball cartridge 32. The ball stack tracker 158 is securely affixed to a belt 162 that loops around an upper pulley 164 rotatably supported by an upper bracket 166 affixed to the outer sidewall of the ball cartridge 32 and a lower pulley 168 rotatably supported by a lower bracket 170, likewise affixed to the outer sidewall of the ball cartridge 32. The lower pulley 168 is connected to the input shaft of a potentiometer 172, or the like. Output of the potentiometer 172 is sent via an electrical lead 174 to the processor 84, which translates the output of the potentiometer 172 into a relative position of a top of the ball stack 36. That information is sent via the control/power umbilical 66 to the control console 64, which displays the relative position of the top of the ball stack 36. This permits the operator to verify a ball drop and confirm that only the desired ball has been dropped from the ball stack 36.

As will be understood by those skilled in the art, the mechanism for tracking the height of the ball stack 36 supported by the ball rail 34 can be implemented in many ways aside from the one described above with reference to FIG. 7. For example, a relative position of the ball stack tracker 158 can be determined using a linear potentiometer, a string potentiometer, an absolute or incremental encoder, a laser range finder, a photoelectric array, etc.

Figure 8:
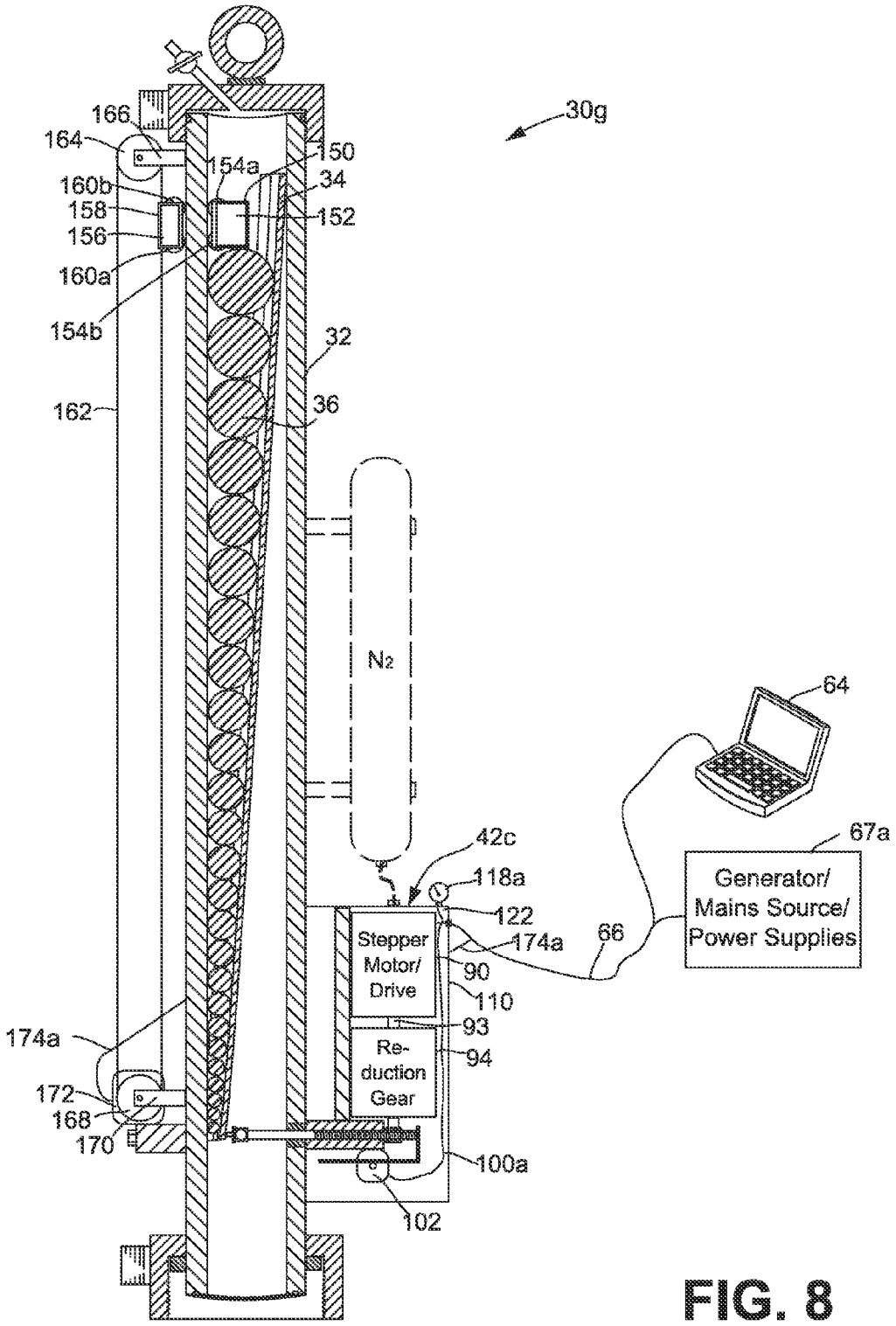
FIG. 8 is a schematic cross-sectional view of another embodiment of the controlled aperture ball drop in accordance with the invention.

FIG. 8 is a schematic cross-sectional view of another embodiment of a controlled aperture ball drop 30*g* in accordance with the invention. The controlled aperture ball drop 30*g* is the same as the controlled aperture ball drop 30*c* described above with reference to FIG. 4 except that it further includes the electro-mechanical ball stack tracking mechanism described above with reference to FIG. 7. In this embodiment, output of the potentiometer 172 is sent via an electrical lead 174*a* incorporated in the control/power umbilical 66 directly to the control console 64. The control console 64 translates the output of the potentiometer 172 into a relative position of a top of the ball stack 36 and displays the relative position of the top of the ball stack 36. This permits the operator to verify a ball drop and confirm that only the desired ball has been dropped from the ball stack 36 after a ball drop command has been sent to the stepper motor/drive 90.

Figure 9:
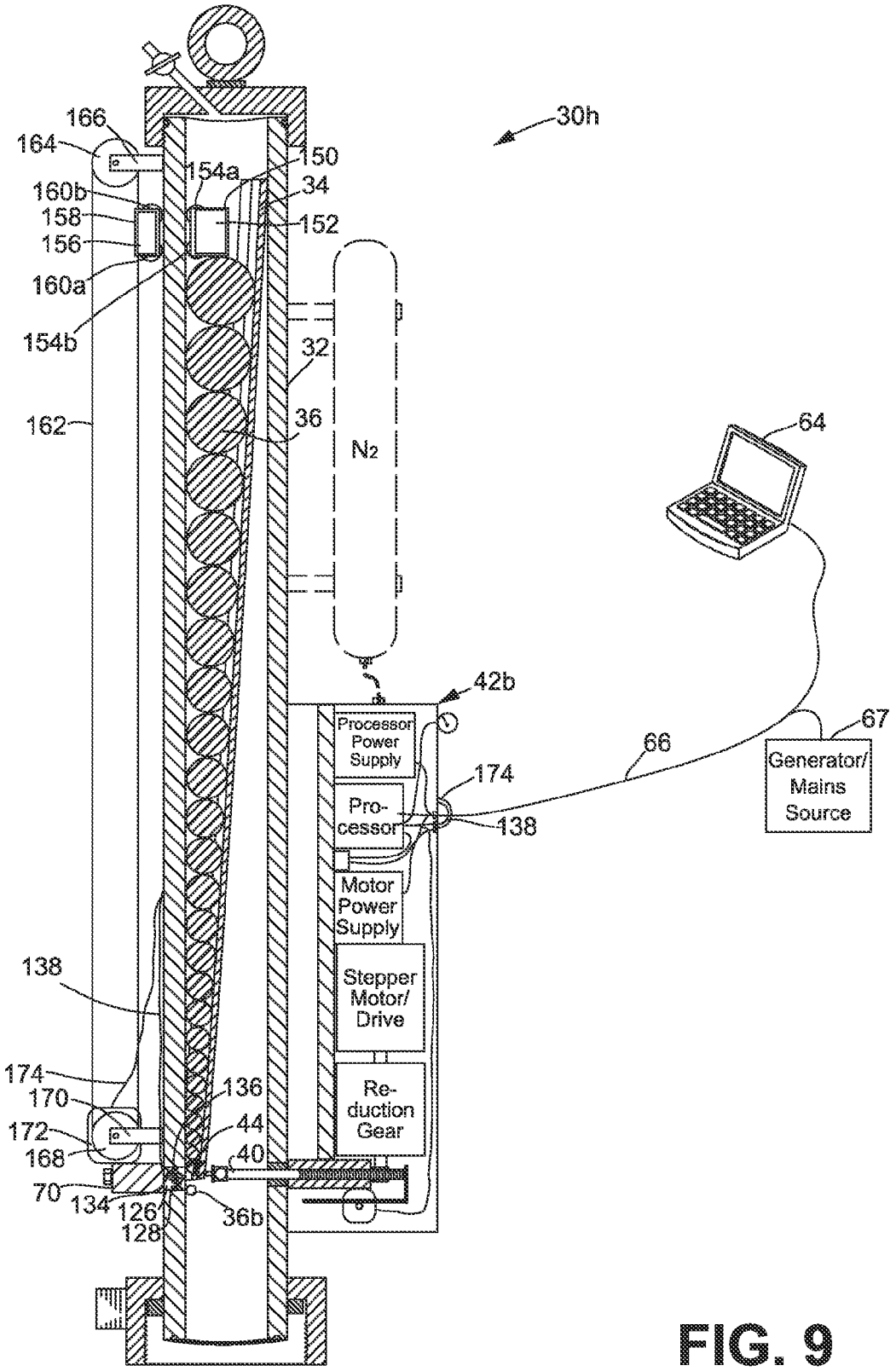
FIG. 9 is a schematic cross-sectional view of yet another embodiment of the controlled aperture ball drop in accordance with the invention.

FIG. 9 is a schematic cross-sectional view of yet another embodiment of a controlled aperture ball drop 30*h* in accordance with the invention. The controlled aperture ball drop 30*h* is the same as the ball drop 30*b* described above with reference to FIG. 3 except that it further includes both the optical detector described above with reference to FIG. 5 and the electro-mechanical ball stack tracking mechanism described above with reference to FIG. 7. The optical detector provides the operator with an indication that a ball has been dropped and the redundant ball stack tracking mechanism verifies that the frac ball stack 36 has moved downwardly by an increment corresponding to a diameter of the frac ball dropped. Of course if either the optical detector or the electro-mechanical ball stack tracking mechanism fails during a well stimulation procedure, the remaining ball drop tracking mechanism is likely to continue to function throughout the procedure so that the operator always has confirmation each time a ball is dropped from the controlled aperture ball drop 30*h*.

Figure 10:
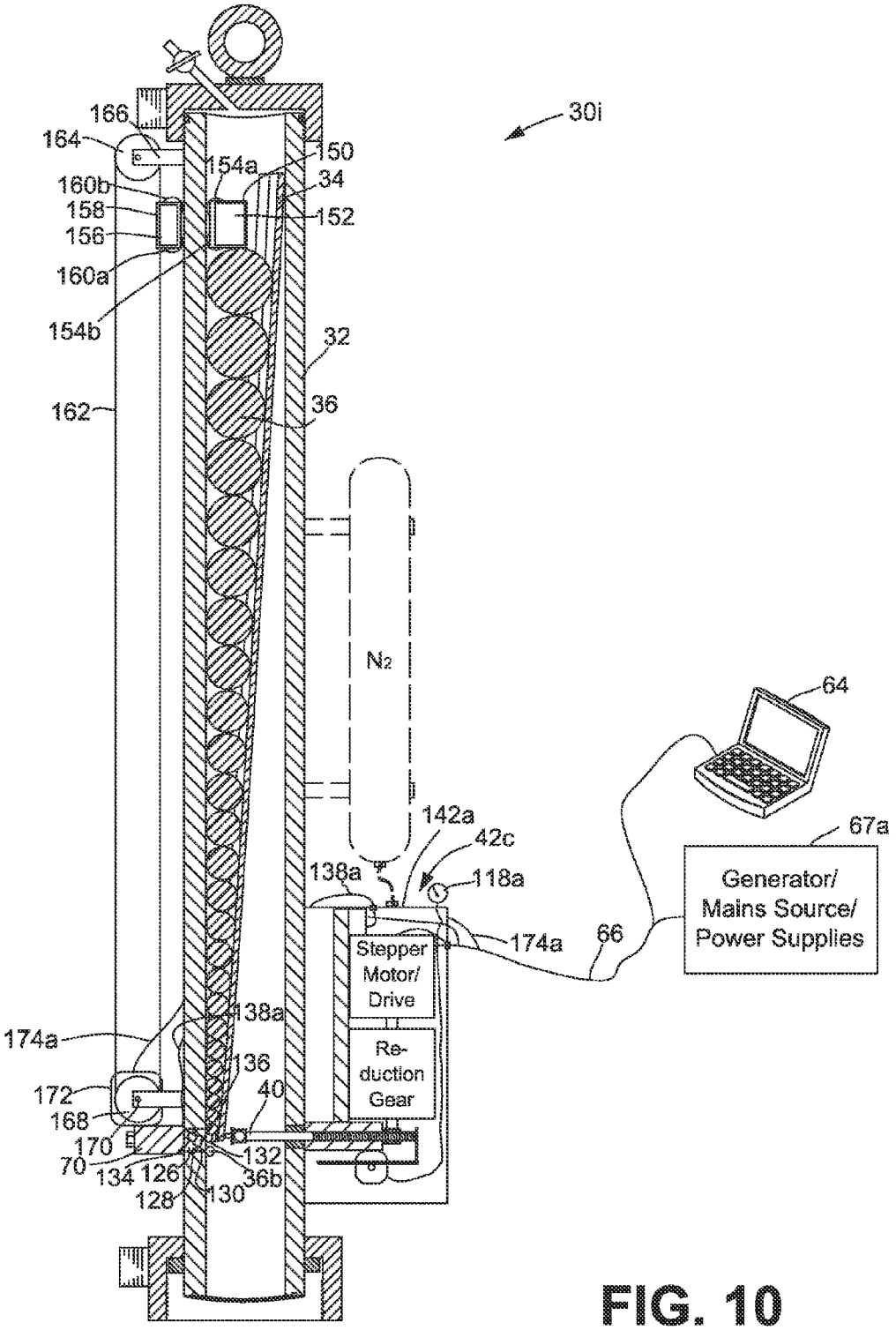
FIG. 10 is a schematic cross-sectional view of yet a further embodiment of the controlled aperture ball drop in accordance with the invention.

FIG. 10 is a schematic cross-sectional view of yet a further embodiment of a controlled aperture ball drop 30*i* in accordance with the invention. The controlled aperture ball drop 30*i* is the same as the ball drop 30*c* described above with reference to FIG. 4 except that it further includes both the optical detector described above with reference to FIGS. 5 and 6, and the electro-mechanical ball stack tracking mechanism described above with reference to FIGS. 7 and 8. As explained above, the optical detector provides the operator with an indication that a ball has been dropped and the redundant ball stack tracking mechanism verifies that the frac ball stack 36 has moved downwardly by an increment corresponding to a diameter of the frac ball dropped. As further explained above, if either the optical detector or the electro-mechanical ball stack tracking mechanism fails during a well stimulation procedure, the remaining ball drop tracking mechanism is likely to continue to function throughout the procedure so that the operator always has confirmation each time a ball is dropped from the controlled aperture ball drop 30*i*.

FIG. 11 is a side elevational view of one embodiment of the ball rail 34 for the embodiments of the controlled aperture ball drop 30*i* shown in FIGS. 1-10, and FIG. 12 is a schematic cross-sectional view of the ball rail shown in FIG. 11, taken along line 12-12 of FIG. 11. In this embodiment the ball rail 34 is substantially V-shaped in cross-section and constructed of 5 layers (200*a*-200*e*) of 14 gauge stainless steel welded together at longitudinally spaced intervals (202*a*-202*j*) along opposite side edges. The ball rail 34 is longitudinally curved to substantially conform to a curvature of the ball stack 36 intended to be dropped when the ball stack 36 is vertically aligned along the inner periphery of the ball cartridge 32. However, the cross-sectional shape of the ball rail 34 is the same along the length of the ball rail, except at the bottom end 38 where a portion of the top edges of some of the laminations are ground or cut away at 204 to allow the V at the bottom end 38 to approach the inner periphery of the ball cartridge 32 close enough to trap the smallest ball in the ball stack 36 to be dropped, e.g. a bit less than ¾" (1.905 cm).

FIG. 13 is a table showing a deflection of the ball rail 34 shown in FIG. 11 at points A, B and C under a 10 lb. (4.54 kg) mass at three spaced apart positions relative to the bottom end 38 of the ball rail 34. As can be seen, the ball rail is quite stiff, which is a condition required to support the ball stack 36 in vertical alignment against the inner periphery of the ball cartridge 36. In general, it has been observed that this degree of stiffness of the ball rail 34 is adequate to provide a functional ball rail 34.

Figure 14:
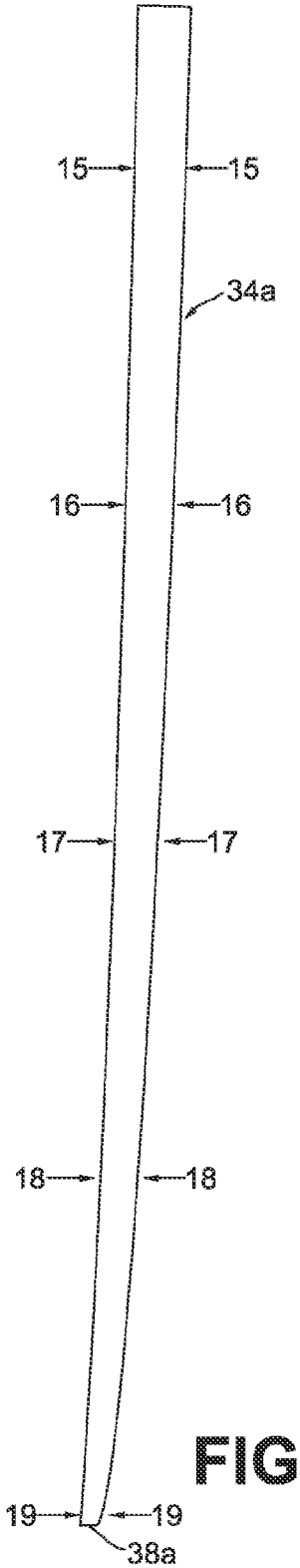
FIG. 14 is a side elevational view of another embodiment of a ball rail for the embodiments of the invention shown in FIGS. 1-10.
Figure 15:
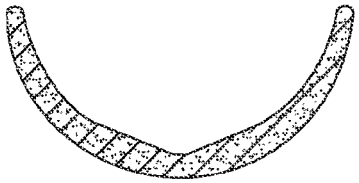
FIGS. 15-19 are schematic cross-sectional views of the ball rail shown in FIG. 14, respectively taken along lines 15-15, 16-16, 17-17, 18-18 and 19-19 of FIG. 14.
Figure 16:
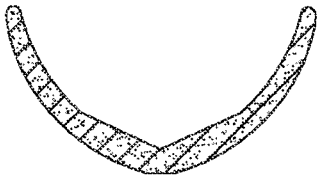
Figure 17:
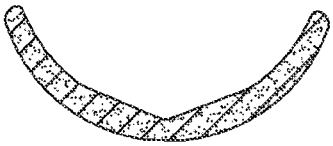
Figure 18:
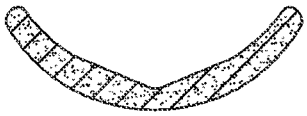
Figure 19:
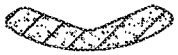

FIG. 14 is a side elevational view of another embodiment of a ball rail 34*a* for the embodiments of the controlled aperture ball drops 30-30*i* shown in FIGS. 1-10, and FIGS. 15-19 are schematic cross-sectional views of the ball rail 34*a* shown in FIG. 14, respectively taken at lines 15-15, 16-16, 17-17, 18-18 and 19-19 of FIG. 14. In this embodiment, the ball rail 34*a* is constructed of a carbon fiber composite, which is known in the art. The ball rail 34*a* is longitudinally curved to substantially conform to the curvature of the ball stack 36 when the ball stack 36 is vertically aligned along the inner periphery of the ball cartridge 32. The cross-sectional shape is substantially constant from the top end to the bottom 38*a* of the ball rail 34*a*. However, a height of the side edges decreases from top to bottom to ensure that 8-10 of the smallest diameter frac balls to be dropped are maintained in a vertical alignment in the ball cartridge 32.

Although these two examples of a ball rail 34 and 34*a* have been described in detail, it should be noted that the ball rail 34 can be machined from solid bar stock; cut from round, square, hexagonal or octagonal tubular stock; or laid up using composite material construction techniques that are known in the art. It should be further noted that there appears to be no upper limit to the stiffness of the rail provide the rail is not brittle.

Figure 20:
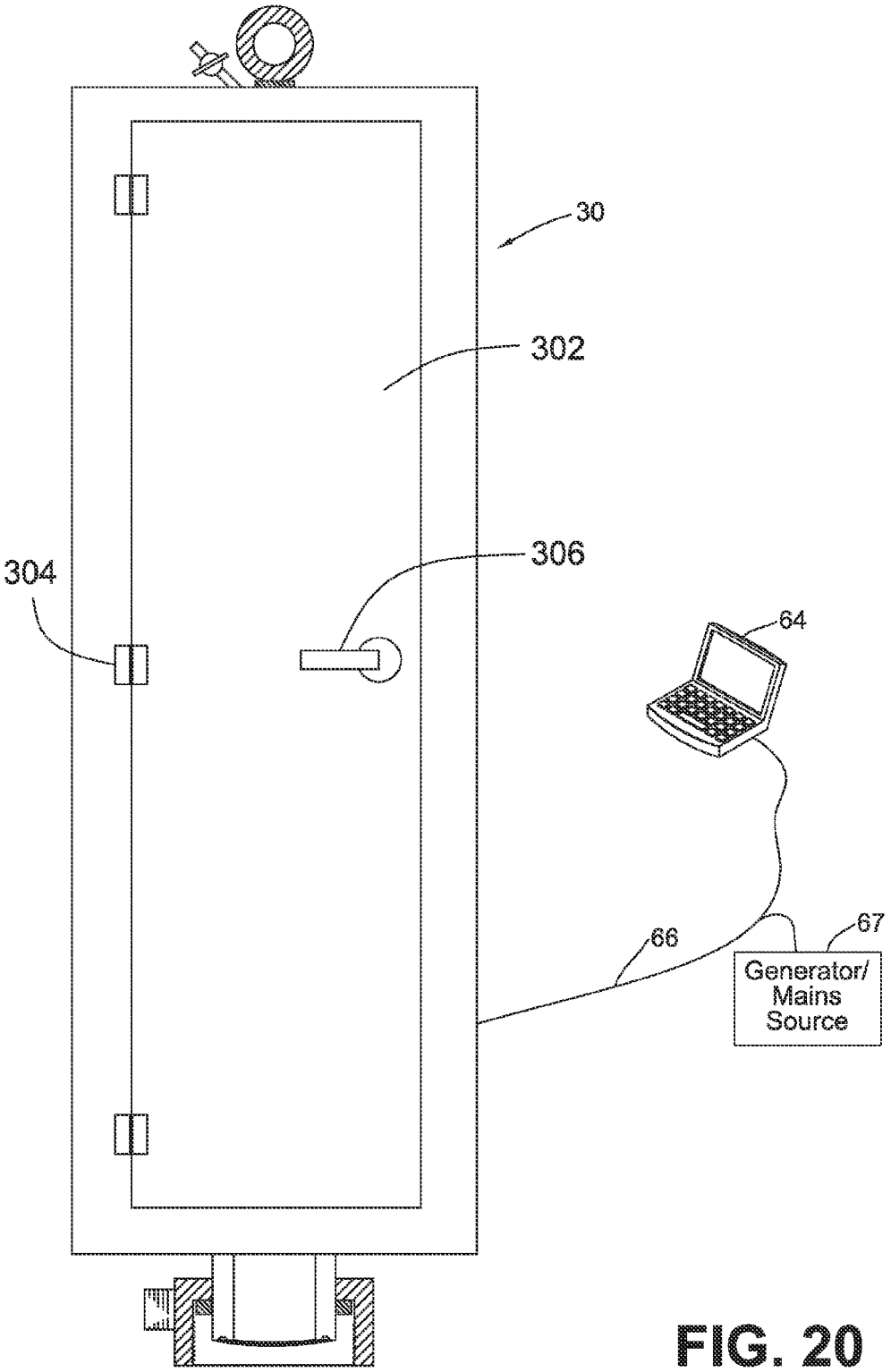
FIG. 20 is a schematic side elevational view of any one of the controlled aperture ball drops shown in FIGS. 1-10 housed in a protective cabinet.

FIG. 20 is a schematic side elevational view of any one of the controlled aperture ball drops 30*a*-30*i* shown in FIGS. 1-10 (hereinafter collectively referred to as controlled aperture ball drop 30) housed in a protective cabinet 300. As explained above the controlled aperture ball drop 30 must operate in open air environments exposed to the elements, as well as pollutants such as dust, sand, flammable and/or corrosive liquids and/or vapors; etc. It is therefore been recognized that it is important to protect the exposed components of the controlled aperture ball drop 30 as much as possible. The protective cabinet 300 provides a sealed closure that inhibits the penetration of ultraviolet radiation, rain, snow or ice as well as any dust, sand, liquids or vapors. Access to the controlled aperture ball drop 30 is provided through an access door 302 supported by hinges 304 in a manner well known in the art. A door handle 306 is designed to maintain the door in a closed position when the protective cabinet 300 is exposed to the inevitable vibration generated during the large volume, high pressure frac fluid pumping required during a well stimulation procedure.

Figure 21:
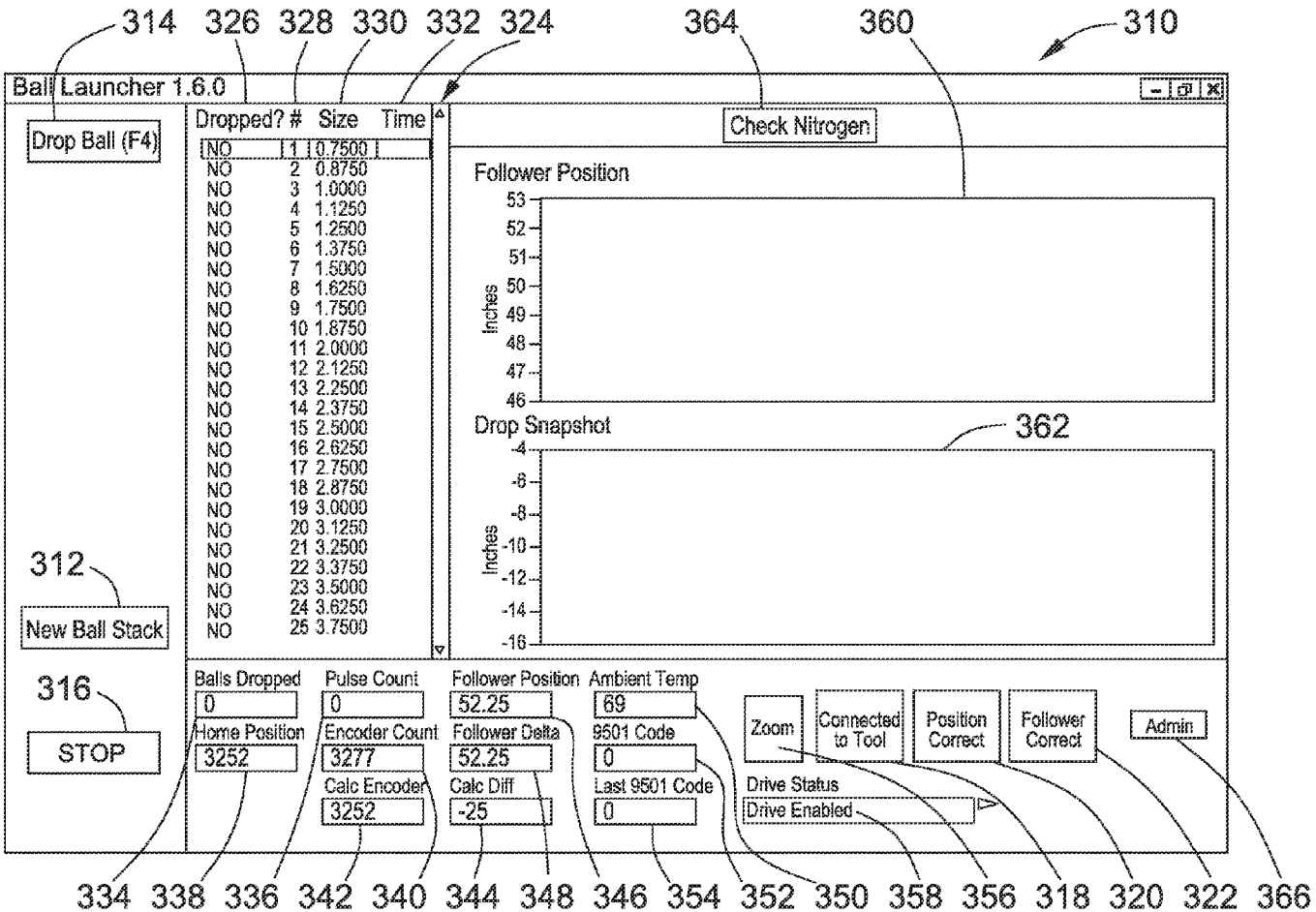
FIG. 21 is a schematic view of a principal user interface displayed by the control console in accordance with the invention.

FIG. 21 is a schematic view of a principal user interface 310 in accordance with one embodiment of the invention displayed by the control console 64. The control console 64 serves as the supervisory command center and user interface for the controlled aperture ball drop 30. The onboard processor 84 (for example, see FIG. 3) on the controlled aperture ball drop 30 executes programmed instructions to interface with sensors and the aperture control hardware, which will be explained below in more detail. The control console 64 is connected to the onboard processor via a communications channel supported by the umbilical 66. The communications channel may be an Ethernet connection, for example. When an operator (not shown) instructs the control console 64 to send a ball drop command to the onboard processor 84, the onboard processor 84 operates autonomously to accomplish the ball drop and returns confirmation data associated with the ball drop to the control console 64. The user interface 310 permits the operator of the controlled aperture ball drop 30 to configure a new ball stack; load the ball stack into the cylindrical ball cartridge 32; drop balls from the ball stack in the size sequence in which they were loaded; and, confirm that each ball was dropped when the operator requested that it be dropped by the controlled aperture ball drop 30. The user interface 310 provides the operator with 3 'action' buttons. These are respectively used to: create a new ball stack 312; drop a frac ball 314 from a bottom of the frac ball stack 36; and, exit the program (STOP 316).

The user interface 310 also provides 3 status indicators that respectively provide feedback to the operator to indicate whether the controlled aperture ball drop 30 is functioning as expected. These status indicators provide feedback to indicate: "Connected to Tool" 318, which indicates that a valid communication connection is established between the control console 64 and the onboard processor 84; "Position Correct" 320, which indicates that the absolute encoder 102 (for example, see FIG. 7) connected to the aperture control arm 40 correlates properly with an expected position based on a number of balls that have been dropped; and, "Follower Correct" 322, which indicates that the ball stack tracker 158 (see FIG. 7) is properly coupled to the ball stack follower 150, which is atop the frac ball stack 36 on the inside of the ball cartridge 32. In accordance with one embodiment of the invention, the respective status indicators 318-322 display a green color if the corresponding monitored conditions are within respective tolerances, and display a red color if they are not. It should be understood that other visual indicators could also be used. For example, the 3 status indicators could display a solid color when the respective condition is within tolerance and flash the same or a different color when the respective condition is not within tolerance, etc.

The user interface 310 also provides a ball stack list 324 having columns that respectively indicate: Drop status 326; ball Number 328; ball Size 330; and drop Time 332. Each time a frac ball is dropped, the Drop status 326 changes from "NO" to "YES" and the drop Time 332 changes from blank to the current time at which the drop command was received by the onboard processor 84. In one embodiment, the row for a next ball to be dropped is also highlighted in a bright color.

Several data displays are also provided to assist the operator in tracking a frac ball drop procedure. Those data displays include:

Balls Dropped 334 which in this example reads "0" because no balls have yet been dropped.

Pulse Count 336, which is the number of drive pulses that have been sent by the onboard processor 84 to the stepper motor/drive 90 with respect to "Home Position". The Home Position is a factory set position in which the size of the ball drop aperture 44 between the bottom end of the ball rail 34 and the sidewall of the ball cartridge 32 retains the smallest frac ball (0.7500") in the ball stack.

Home Position 338, which is expressed as a function of the absolute encoder 102 count when the aperture control arm 40 is the Home Position. In this example, the absolute encoder count is 3252 at the factory set Home Position.

Encoder Count 340 is the actual current absolute encoder count when the aperture control arm 40 has been driven to the Home Position (Pulse Count 336=0). In this example, the Encoder Count is 3277. As understood by those skilled in the art, exposure to high pressure frac fluids stretches mechanical components that contain it and repeated use causes mechanical wear. Consequently, the Encoder Count 3227 will often differ to some extent from the factory set Home Position. Calc Encoder 342 is a computed value of what the absolute encoder count should be, given the Pulse Count 336. Calc Encoder 342 is computed as follows:

1 encoder count=0.000144"

1 encoder count=36.8 drive pulses; therefore:

Calc Encoder=Home Position+Pulse Count/36.8

Calc Diff 344 is Encoder Count 340 minus Calc Encoder. In this example, Calc Diff 344 is 3277−3252=−25.

Follower Position 346 is the Position of the ball stack tracker 158 (see FIG. 7, for example) expressed in inches from a bottom of the frac ball stack. As will be explained below in detail, the Follower Position 346 is one data item used to determine when a frac ball has been dropped from the frac ball stack 36.

Follower Delta 348 is Follower Position 346 at an end of a last ball drop move of the aperture control arm 40, minus Follower Position 346 at an end of a current ball drop move of the aperture control arm 40. In this example, Follower Delta is equal to Follower Position 346 because a new ball stack 36 has just been created and the ball stack tracker 158 has just been moved from a bottom of the ball cartridge 32 to a top of the ball cartridge 32 as shown for example in FIG. 7, where it is magnetically coupled to the ball stack follower 150.

Ambient Temp 350 is a temperature inside the protective cabinet 300, which must be monitored by the operator to ensure that the temperature does not exceed predetermined operating limits.

9501 Code 352 displays an error code used to alert the operator when the aperture controller 30 experiences an "under voltage fault" condition, which can occur if the external power supply or the power supply 67, 67*a* is not connected, the power supplied does not meet minimum power supply voltage specifications, or a short circuit develops; or an "over voltage fault" condition develops, which can occur when the external power supply 67, 67*a* voltage exceeds the power supply specifications of the controlled aperture ball drop 30.

Last 9501 Code 354 displays the previously displayed 9501 Code, if any, for diagnostic purposes.

Zoom 356 button permits the operator to reposition a Y-axis of a Follower Position graph 360 prior to a ball drop. The Follower Position graph 360 provides the operator with a graphical representation of a movement of the ball stack tracker 158 in real time during a ball drop, as will be explained in detail below with reference to FIG. 32. The Zoom 356 button positions the ball drop trace at a top of the Y-axis of the chart so the entire ball drop event will be displayed, because the Y-axis limits the range of values that can be displayed. This prevents the trace from dropping off of the graph during a ball drop.

Drive Status 358 indicates whether the stepper motor/drive 90 is enabled or disabled.

Follower Position graph 360 provides the operator with a graphical representation of Follower Position 346, and as explained above.

The Drop Snapshot graph 362 provides the operator with a graphical representation of the movement of the ball stack tracker 158 after a ball drop is completed, as will also be explained below with reference to FIG. 32.

Check Nitrogen alarm indicator 364 alerts the operator if nitrogen pressure within the aperture controller 42 drops below a predetermined threshold. In one embodiment, the Check Nitrogen alarm indicator 364 displays a green color when the nitrogen pressure is within tolerance and displays a red color when it is not within tolerance.

Admin button 366 permits authorized personnel to access administration functions after an appropriate authentication has been performed. Administration functions will be explained below with reference to FIGS. 35 and 36.

Figure 22:
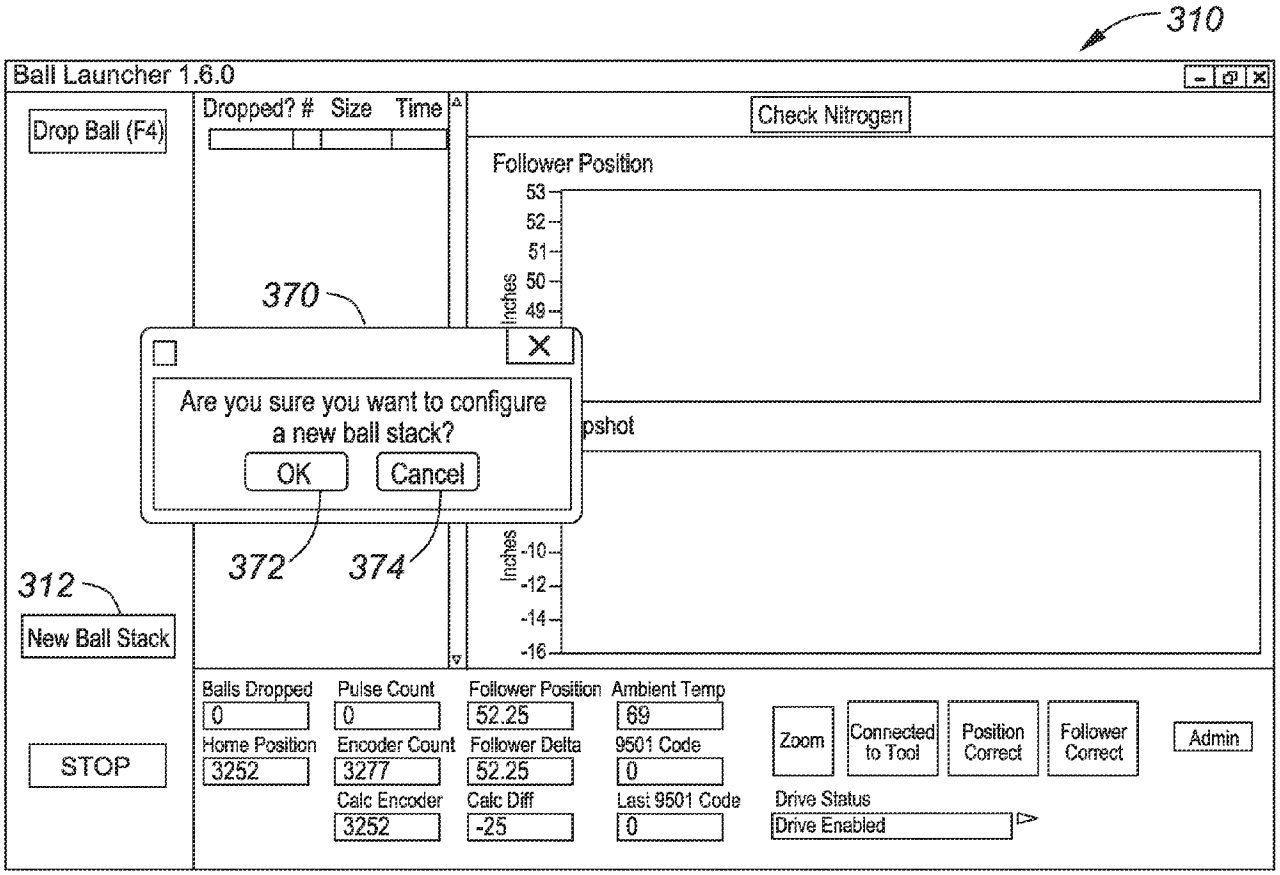
FIG. 22 is a schematic view of the user interface shown in FIG. 21 overlaid by a configure new ball stack confirmation window in accordance with the invention

FIG. 22 is a schematic view of the user interface shown in FIG. 21 overlaid by a configure new ball stack confirmation window 370, which is displays if the operator selects the New Ball Stack 312 button. Since any action by an operator can have significant consequences, every action must be confirmed. Consequently, when the operator selects the New Ball Stack 312 button, the operator must confirm that action by selecting the OK button 372. If the New Ball Stack 312 button was selected by mistake, the operator can select the Cancel 374 button to abort the new ball stack configuration operation. New ball stacks are always created with the controlled aperture ball drop 30 supported in a horizontal position on a trailer or other stable flat surface.

Figure 23:
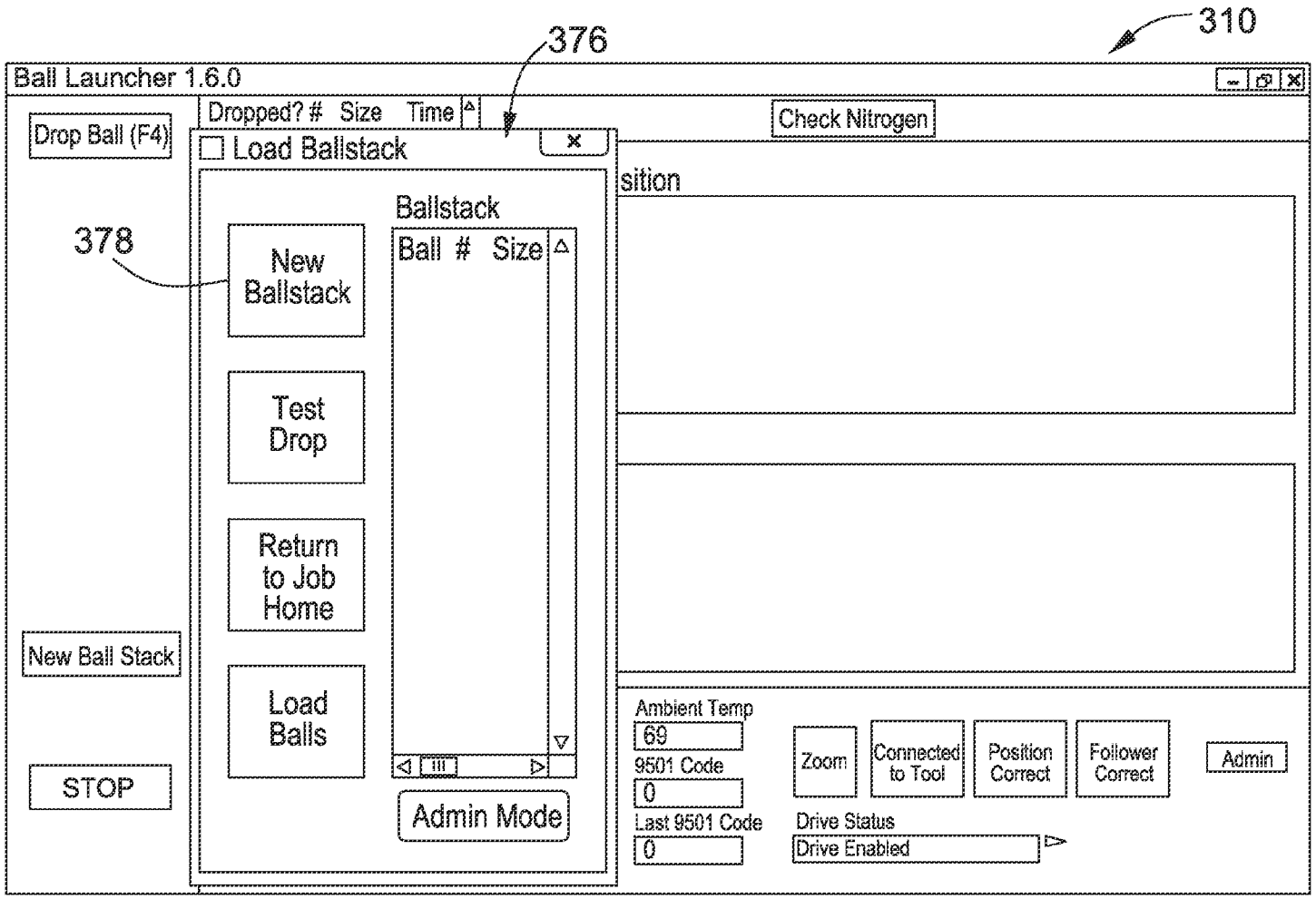
FIG. 23 is a schematic view of the user interface shown in FIG. 21 overlaid by a load ball stack window in accordance with the invention.

FIG. 23 is a schematic view of the user interface shown in FIG. 21 overlaid by a load ball stack window 376, which is displayed after the operator selects the OK button 372 on the configure new ball stack confirmation window 370. When presented with this load ball stack window 376, the operator must select the New Ballstack button 378, or close the window.

Figure 24:
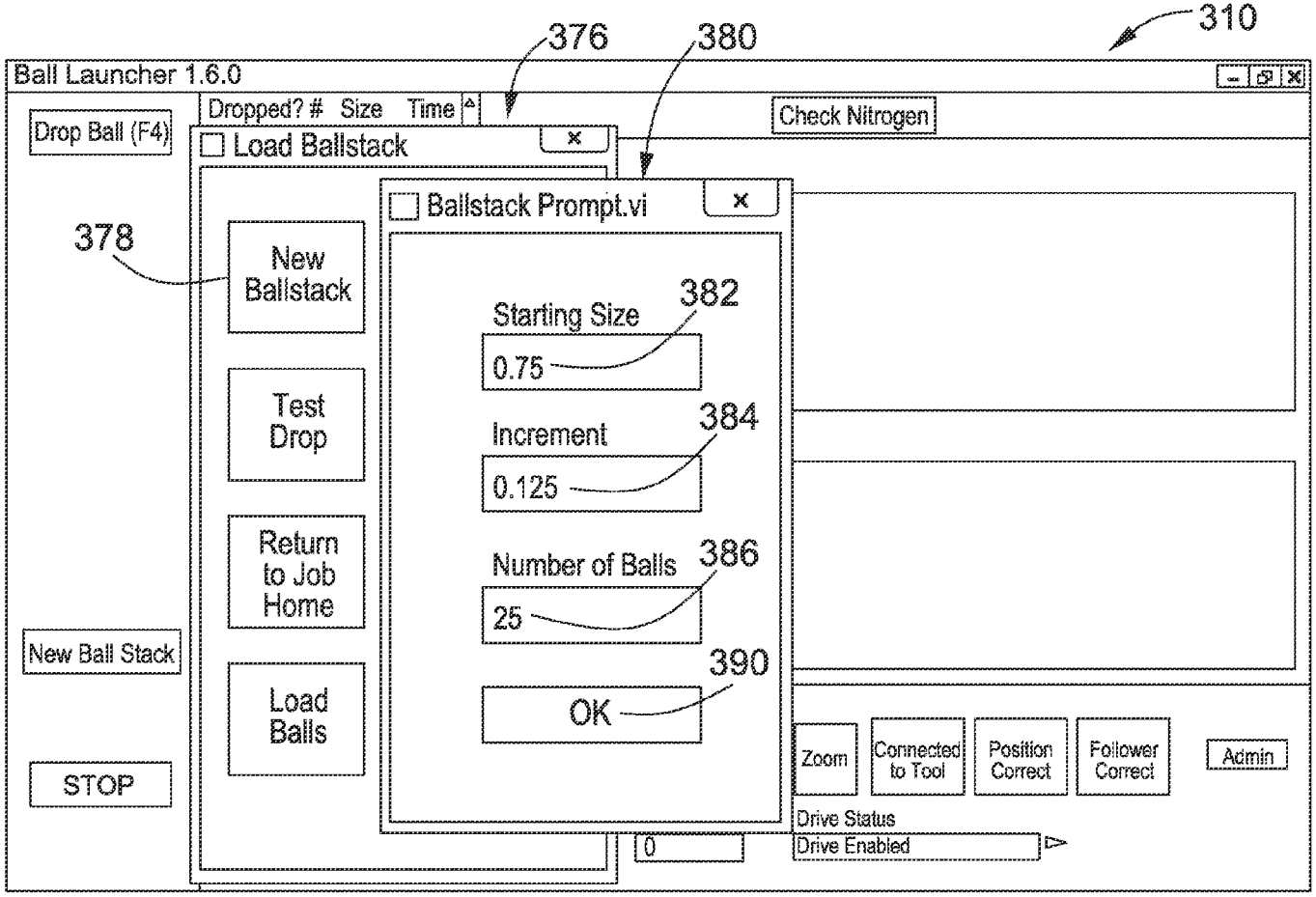
FIG. 24 is a schematic view of the load ball stack window shown in FIG. 23 overlaid by a ball stack prompt window in accordance with the invention.

FIG. 24 is a schematic view of the load ball stack window 376 shown in FIG. 23 overlaid by a Ballstack Prompt window 380. The Ballstack Prompt window 380 requires three operator inputs: Starting Size 382, in which the operator inputs the size of the smallest frac ball in the frac ball stack 36 to be created; Increment 384, which is the size increment of the balls in the frac ball stack. In this example, the size increment is 0.125 (⅛"); and, Number of Balls 386, which is the total number of balls in the frac ball stack. These three values must be input even if the size increment is not consistent between all of the balls in the frac ball stack 36. This sometimes happens if a sliding sleeve was omitted when the production casing was installed, because the frac ball size must match the sliding sleeve seat size, as understood by those skilled in the art. If the size of a frac ball in the newly created ball stack has to be adjusted, the operator may accomplish that after onboard processor 84 has created the new ball stack and it has been displayed by the control console 64 in the Load Ballstack window 376. The operator double clicks on any ball size(s) that must be adjusted, which permits the ball size to be changed. After the three values 382, 384 and 386 are entered the operator selects the OK button 390.

Figure 25:
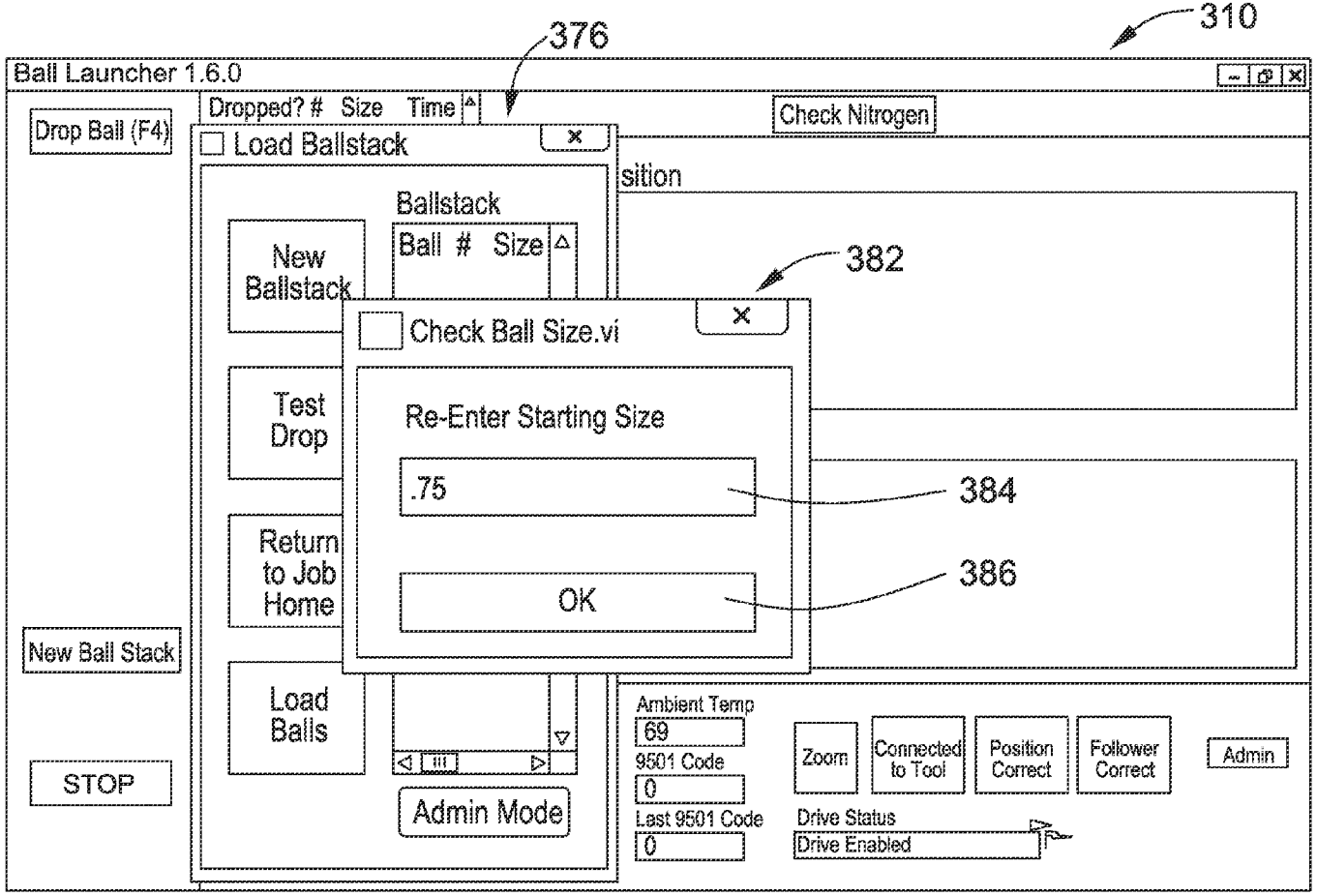
FIG. 25 is a schematic view of the load ball stack window shown in FIG. 23 overlaid by a starting ball size confirmation window in accordance with the invention.

FIG. 25 is a schematic view of the load ball stack window 376 shown in FIG. 23 overlaid by a starting ball size confirmation window 382, which appears after the operator selects the OK button 390. The operator must re-enter the starting ball size at 384 and select the OK button 386 to permit the control console 64 to pass the new ball stack information to the onboard processor 84, which executes programmed instructions to create the new ball stack using the starting ball size, ball increment and number of frac balls to be dropped to generate the ball stack list 324 described below in more detail with reference to FIG. 35.

Figure 26:
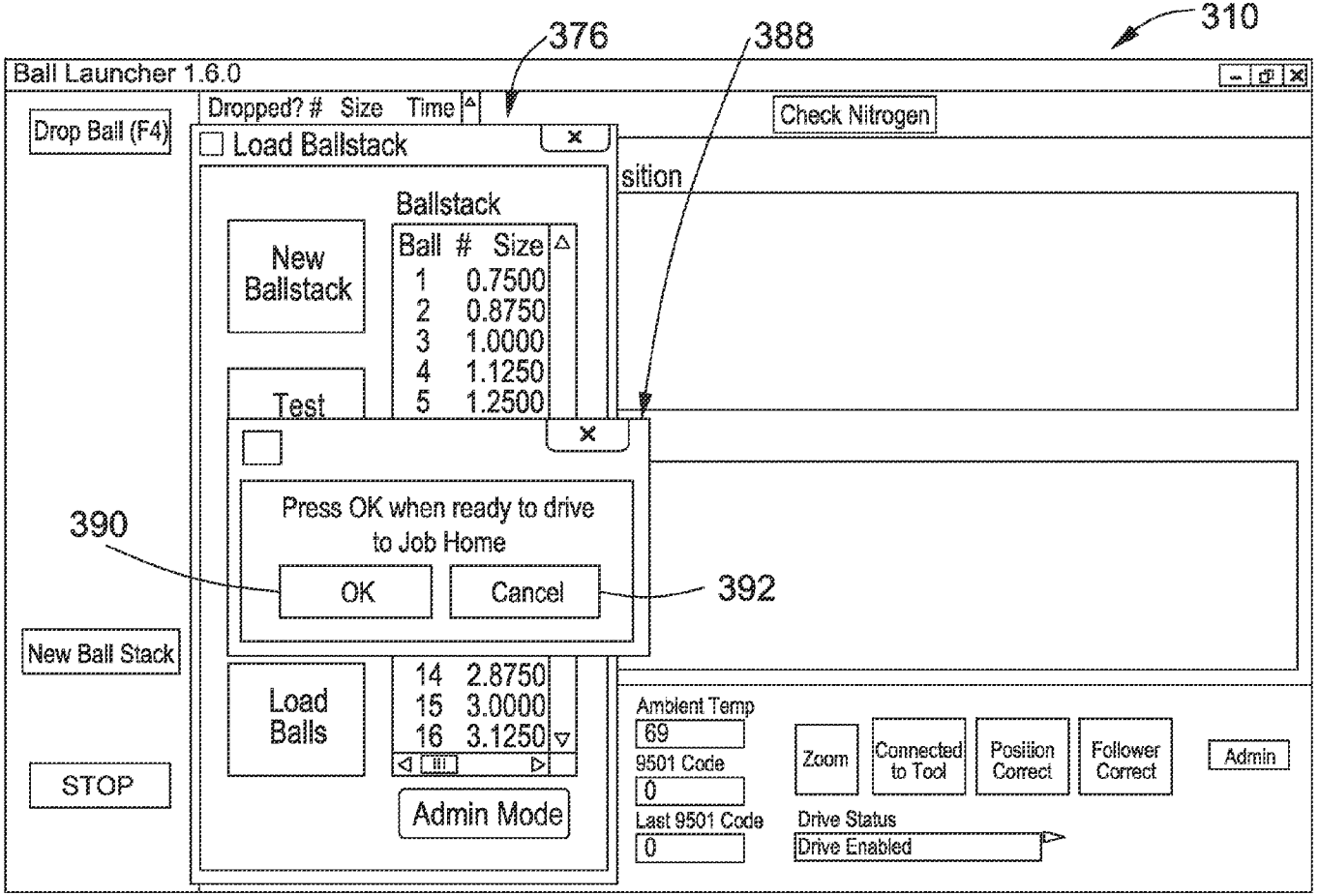
FIG. 26 is a schematic view of the load ball stack window shown in FIG. 23 overlaid by a drive to job home instruction window in accordance with the invention.

FIG. 26 is a schematic view of the load ball stack window 376 shown in FIG. 23 overlaid by a drive to job home instruction window 388. Before selecting the OK button 390, the operator must verify that the ball cartridge is empty and clean so neither the ball rail 34 nor the aperture control arm 40 will be damaged when the ball rail is driven to the Home Position. Once the operator selects the OK button, the onboard processor 84 drives the aperture control arm 40 to the Home Position by sending the Pulse Count 366 number of reverse drive pulses to the stepper motor/drive 90.

Figure 27:
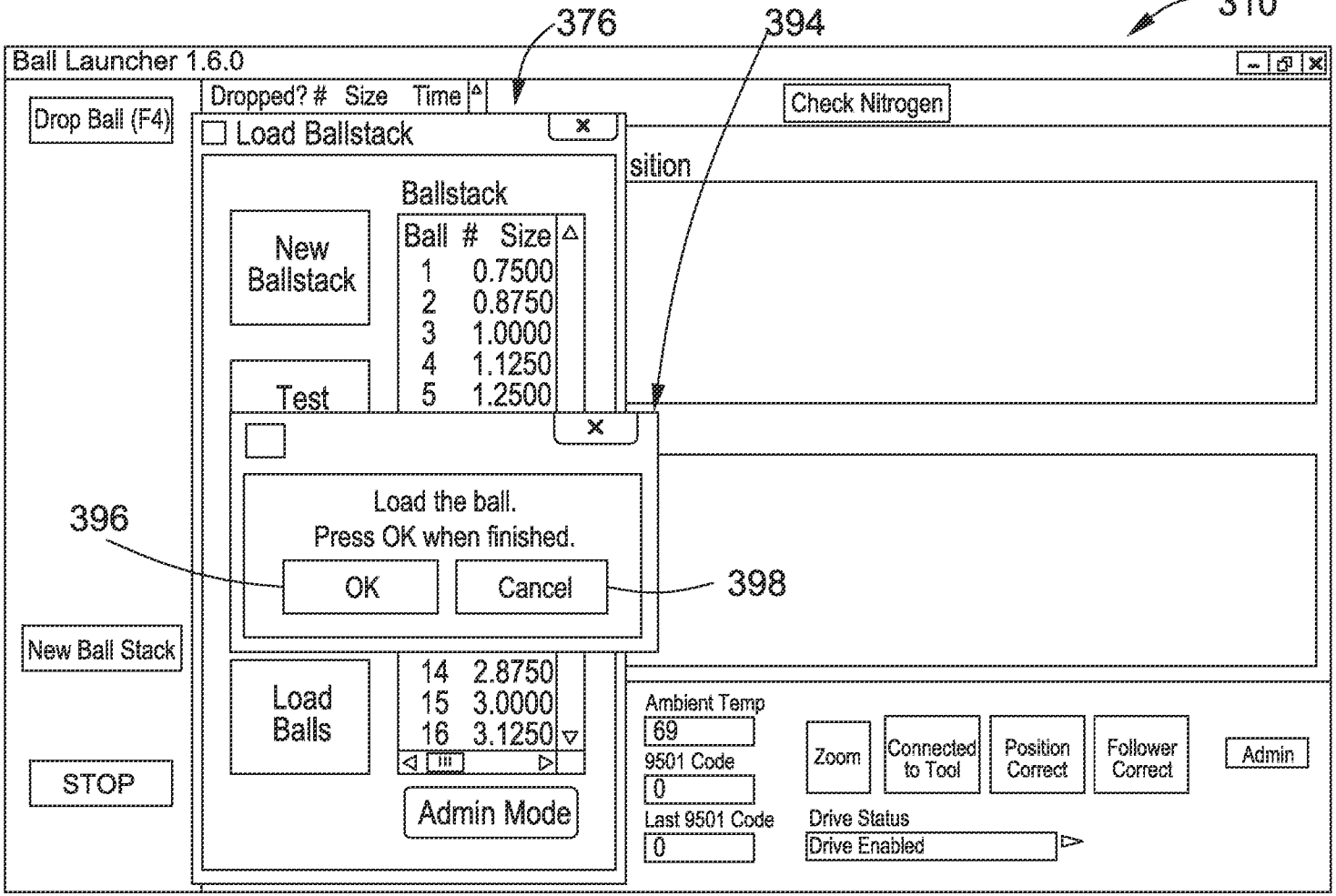
FIG. 27 is a schematic view of the new ball stack window shown in FIG. 23 overlaid by a ball stack loaded acknowledgement window in accordance with the invention.

FIG. 27 is a schematic view of the load ball stack window 376 shown in FIG. 23 overlaid by a ball stack loaded acknowledgement window 394. When presented with this window, the operator must load each frac ball onto the ball rail 34 in the ball cartridge 32 in order of size sequence. After all of the frac balls are loaded, the top cap 48 is installed and the operator selects the OK button 396 or cancels the operation by selecting the Cancel button 398.

Figure 28:
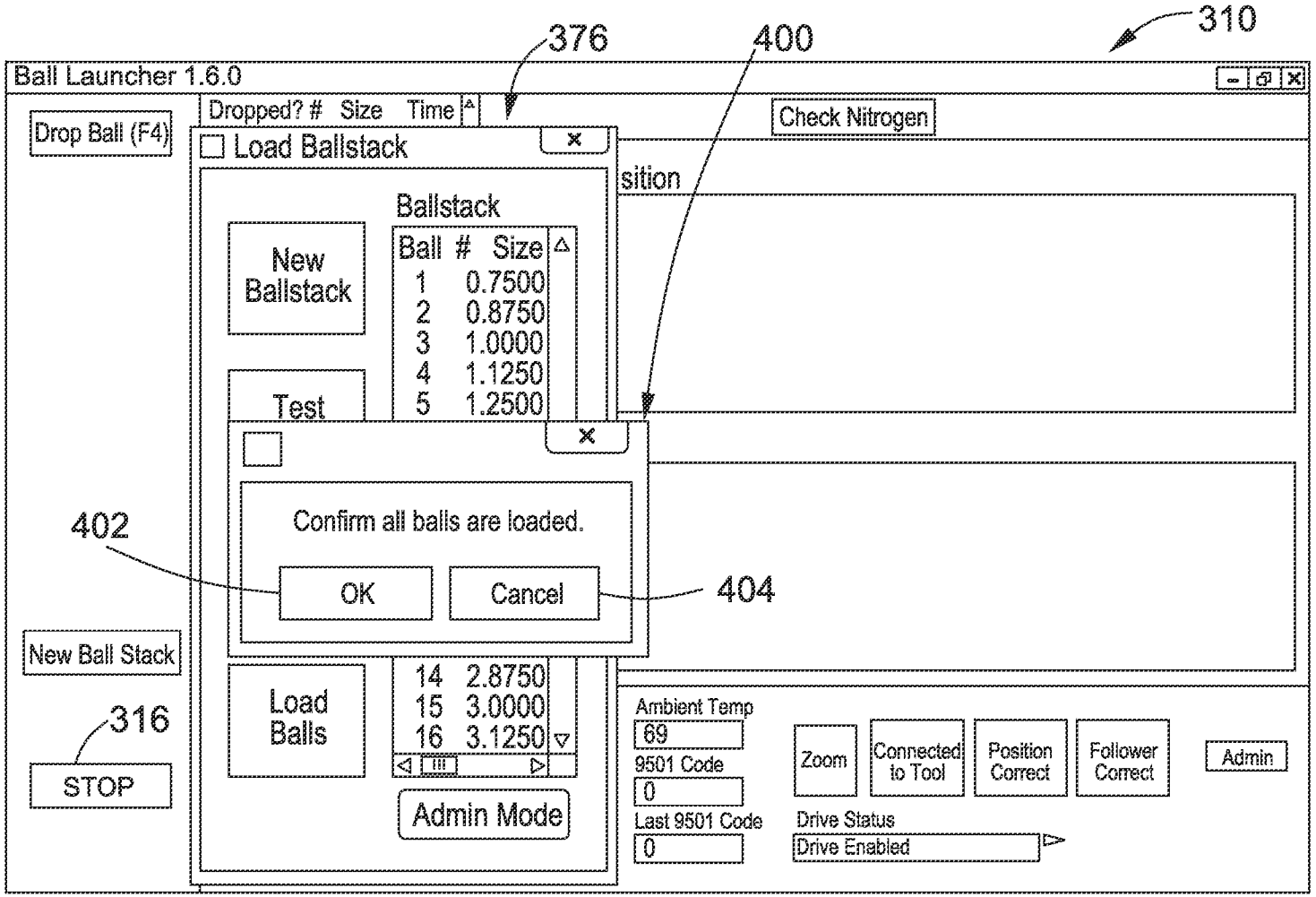
FIG. 28 is a schematic view of the new ball stack window shown in FIG. 23 overlaid by a ball stack loaded confirmation window in accordance with the invention.

FIG. 28 is a schematic view of the load ball stack window 376 shown in FIG. 23 overlaid by a ball stack loaded confirmation window 400, which is displayed after the operator selects the OK button 396. The operator confirms that each of the frac balls has been loaded in size sequence by selecting the OK button 402. If all balls have not been loaded, the operator must select the Cancel button 404. Once the OK button 402 has been selected, the operator selects the Stop button 316. The Stop button 316 closes the user interface 310 and terminates the communication link between the control console 64 and the onboard processor 84. The onboard processor 84 continually checks for connections to the control console 64 until the external power supply 67, 67*a* is disconnected, which happens when the operator physically switches off the onboard processor 84. This permits the controlled aperture ball drop 30 to be hoisted onto the frac stack and be mounted to a frac head or a high pressure fluid conduit so that a well stimulation procedure can be commenced.

Figure 29:
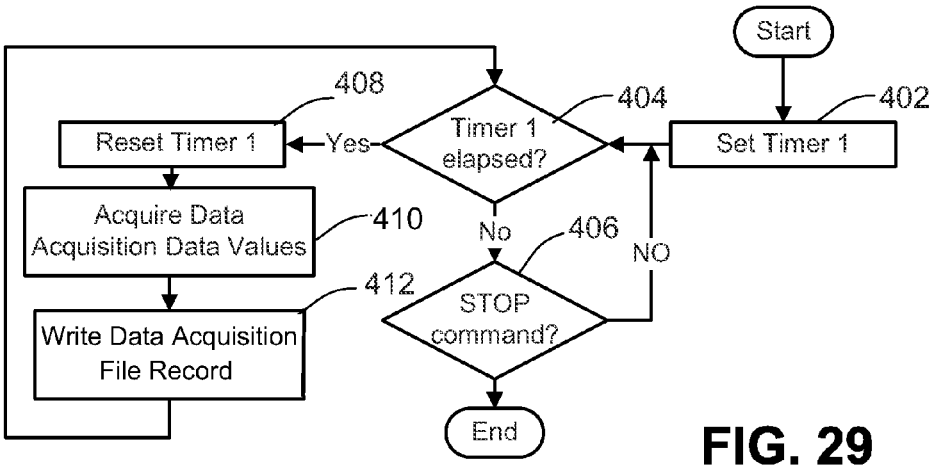
FIG. 29 is a flow chart depicting an algorithm that governs the writing of records to a data acquisition file that executes uninterruptedly while a ball stack is loaded and power is supplied to the aperture controller in accordance with the invention.

FIG. 29 is a flow chart depicting an algorithm that governs programmed instructions executed by the onboard processor 84 to write records to a data acquisition file. The programmed instructions execute uninterruptedly after a ball stack is loaded and power is supplied to the aperture controller. On power up the onboard processor 84 executes programmed instructions that set Timer 1 at 402. In one embodiment, Timer 1 is set and reset to 10 seconds so that a data acquisition file record is written every 10 seconds even during idle periods so long as a ball stack exists and the controlled aperture ball drop 30 is powered on. The onboard processor 84 routinely checks Timer 1 at 404 to determine if it has elapsed. If not, the onboard processor 84 determines at 406 if the Stop button 316 has been selected, which powers down the controlled aperture ball drop 30. If so, the process ends. If not the onboard processor returns to routinely checking Timer 1 at 404. When Timer 1 has elapsed, Timer 1 is reset at 408, data acquisition data values are acquired at 410 by the onboard processor 84. Each data acquisition file record contains the following data items:

Timestamp (Current date and time); Ball Number; Ball Size; Aperture Control Arm State (Idle/Jog); Pulse Count; Encoder Count; Follower Position; and, Temperature (in cabinet 300).

A data acquisition file record is then written at 412. After the data acquisition file record is written, the onboard processor 84 recommences monitoring Timer 1 at 404.

Figure 30:
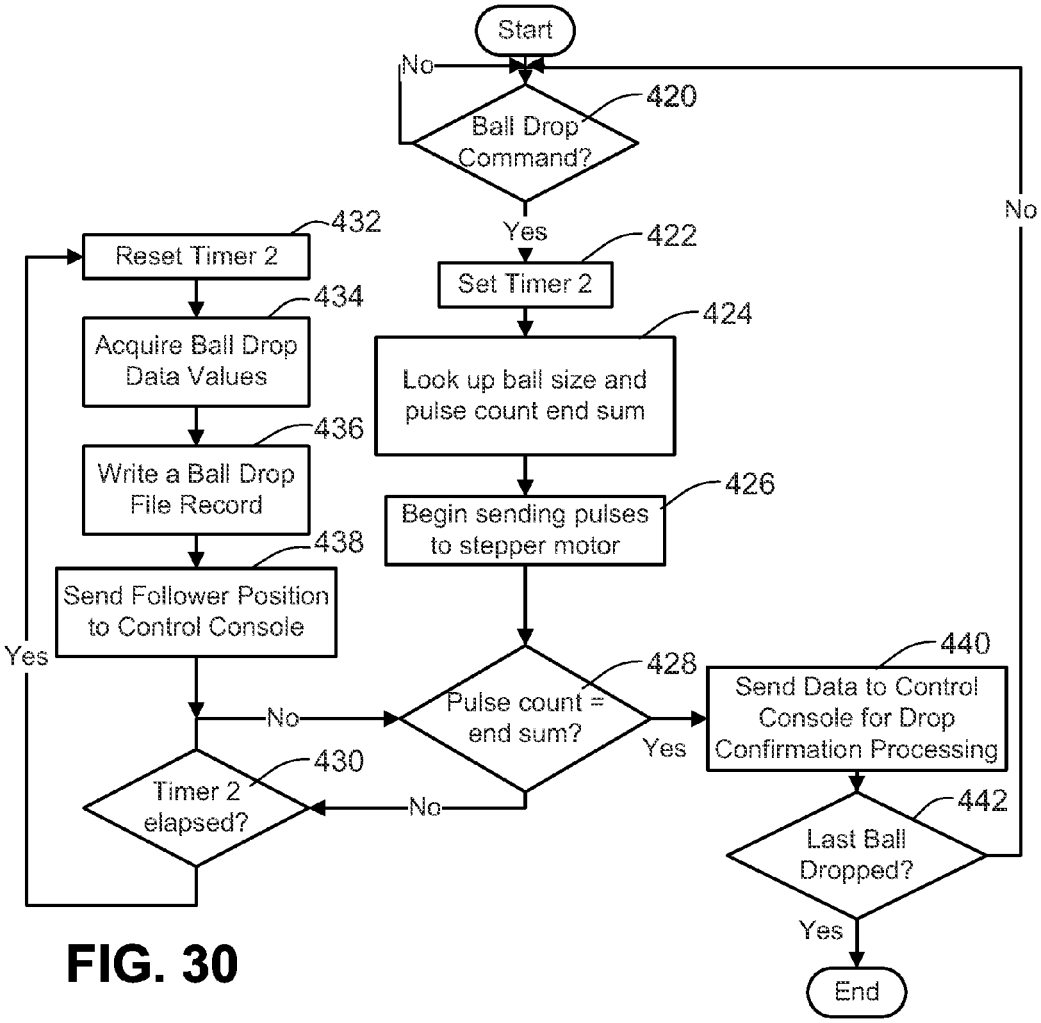
FIG. 30 is a flow chart depicting an algorithm that governs the writing of records to a ball drop data file that executes uninterruptedly while the aperture controller is operating to drop a frac ball.

FIG. 30 is a flow chart depicting an algorithm that governs programmed instructions executed by the onboard processor 84 to write records to a ball drop data file. The onboard processor 84 executes the programmed instructions uninterruptedly while onboard processor 84 is operating the aperture control arm 40 to drop a frac ball. The ball drop data file has a unique file name associated with the date/time the file was created. A new ball drop data file is created each time a new ball stack is created. Data is written to the ball drop data file while the aperture control arm 40 is being moved by the stepper motor/drive 90.

The onboard processor 84 continually monitors 420 a communication channel established with the control console 64 for receipt of a ball drop command. When a ball drop command is received, the onboard processor 84 sets 422 a Timer 2 to a predetermined time interval. In accordance with one embodiment of the invention, Timer 2 is set to 0.1 seconds. The onboard processor 84 then looks up 424, in a table created when the ball stack was created by the onboard processor 84, the end sum for drive pulses to be sent to the stepper motor/drive 90 in order to drop the next frac ball. In accordance with one embodiment of the invention, when a new ball stack is created, the onboard processor 84 examines the size of each ball to be dropped, compares that size with the size of the previous frac ball to be dropped, computes the difference in diameter and converts the difference to drive pulses, which is then added to a current pulse count end sum to compute a pulse count end sum for the ball to be dropped. 1 drive pulse moves the aperture control arm 40 a linear distance of 0.0000037", so 32,000 drive pulses are required to move the aperture control arm 40 a distance of 0.125", which is required to drop a frac ball that is ⅛" larger than the last frac ball dropped. Alternatively, the onboard processor 84 may compute the number of pulse counts required for each ball drop at 424 after a ball drop command is input by the operator.

Once the pulse count end sum has been looked up, or otherwise determined, the onboard processor 84 begins 426 sending drive pulses to the stepper motor/drive 90. The onboard processor 84 continues to send drive pulses to the stepper motor/drive 90 while determining 428 if the pulse count equals the pulse count end sum. If not, the onboard processor 84 determines 430 if Timer 2 has elapsed while continuing to send drive pulses to the stepper motor/drive 90. If Timer 2 has not elapsed, the onboard processor 84 again checks the pulse count at 428. If Timer 2 has elapsed, the onboard processor 84: resets 432 Timer 2; acquires 434 ball drop data values; and, writes 436 a ball drop file record, while continuing to send drive pulses to the stepper motor/drive 90. In accordance with one embodiment of the invention the data values acquired at 434 are:

Timestamp (Current date and time); Ball Number; Ball Size; Pulse Count; Encoder Count; Follower Position; and, Temperature (in cabinet 300).

In one embodiment of the invention, data gets written to the ball drop data file for each of the parameters described above at a rate of once every 0.1 seconds. This records data associated with each parameter at a rate of 10 frames/second which enables analysis of exact drop points during the movement of the aperture control arm 40. Periodically, the actual drop points are compared to theoretical drop points to permit calibration adjustments to Home Position be made, if necessary, as will be further described below with reference to FIGS. 34-36.

After the ball drop file record is written, the onboard processor sends the Follower Position acquired at 434 to the control console 64 to permit the control console to paint the Follower Position graph 360, as will be explained below with reference to FIG. 32, and checks the pulse count at 428. These steps are repeated while the onboard processor 84 continues to send drive pulses to the stepper motor/drive 90 until the pulse count equals the pulse count end sum, as determined at 428. When the pulse count equals the pulse count end sum, the onboard processor 84 sends data at 440 to the control console 64 for frac ball drop confirmation processing, which will also be explained below in more detail with reference to FIG. 32. Onboard processor 84 then determines at 442 if the last frac ball has been dropped. If so, ball drop processing ends. If not, the onboard processor 84 returns to 420 to monitor for a next ball drop command.

Figure 31:
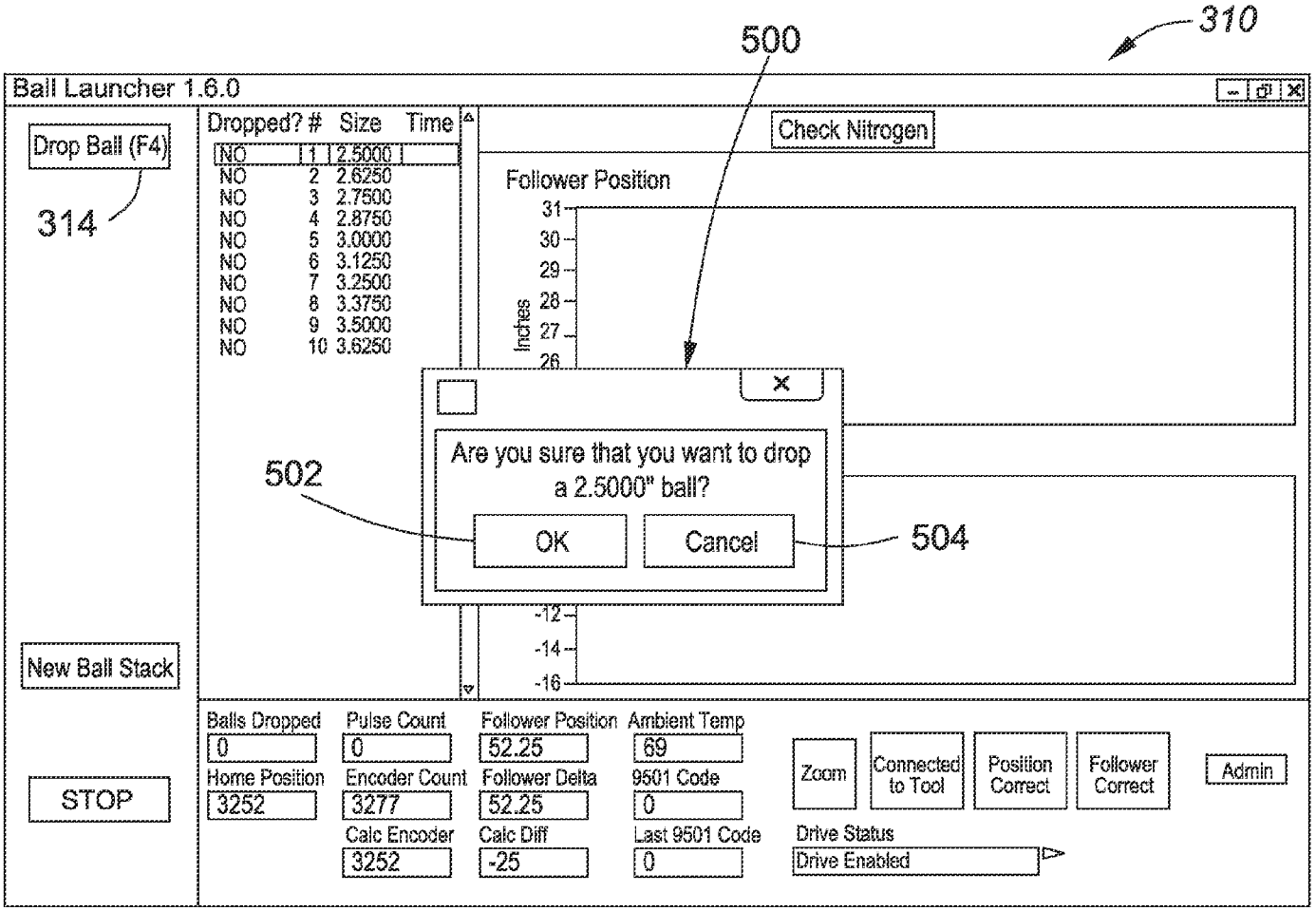
FIG. 31 is a schematic view of the principal user interface window shown in FIG. 21 overlaid by a ball drop confirmation window in accordance with the invention.

FIG. 31 is a schematic view of the principal user interface window 310 shown in FIG. 21 overlaid by a ball drop confirmation window 500, which is presented each time the operator presses function key F4 or selects the Drop Ball button 314 to ensure that the operator intended to drop the next frac ball from the frac ball stack 36. The operator is presented with a text message that indicates the size of the next frac ball to be dropped and requests confirmation of the ball drop. The operator may drop the ball by selecting the OK button 502 or cancel the ball drop by selecting the Cancel button 504. When the operator selects the OK button 502, the control console sends a ball drop command to the onboard processor 84, which performs the procedure described above with reference to FIG. 30.

Figure 32:
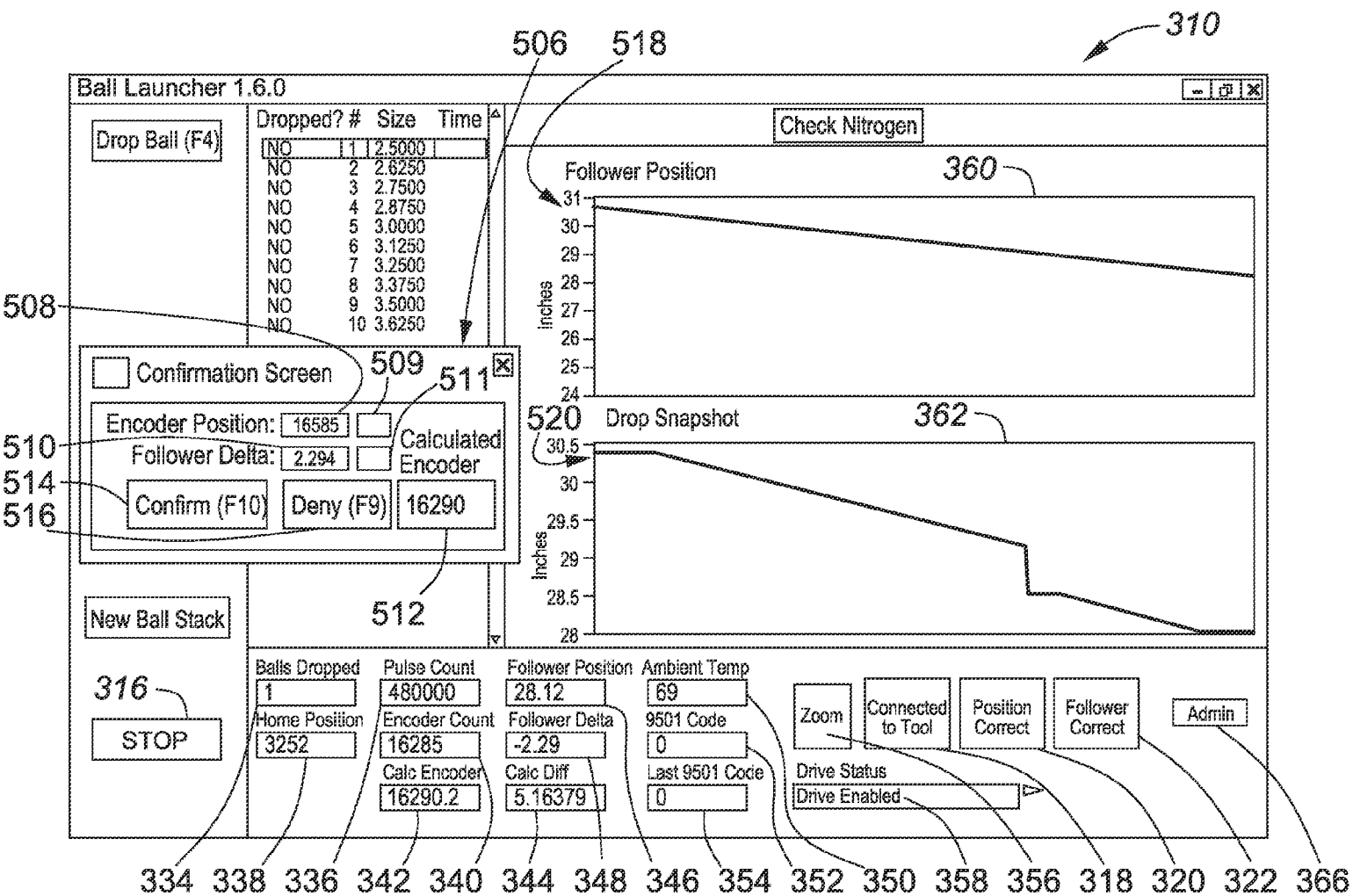
FIG. 32 is a schematic view of the principal user interface window immediately following a successful ball drop, overlaid by a ball drop confirmation information window in accordance with the invention.

FIG. 32 is a schematic view of the principal user interface window 310 immediately following completion of a ball drop, overlaid by a ball drop confirmation information window 506, which presents the operator with information about the position of the absolute encoder 172 and the ball stack tracker 158 following the drop, to confirm that the ball drop has been successful. Although this information is also available on the principal user interface window 310 at Encoder Count 340; Calc Encoder 342 and Follower Delta 348; it is redisplayed as Encoder Position 508; Follower Delta 510; and, Calculated Encoder 512. In addition, color coded flags 509, 511 generated by the control console 64 respectively indicate whether the Encoder Position 508 and Follower Delta 510 are within predetermined tolerances. In one embodiment, the color coded flags 509 and 511 are respectively a green color if those values are within their respective tolerances and red if they are not. The operator may select the Confirm button 514 or the Deny button 516, depending on the color of the respective flags 509, 511. If the Deny button 516 is selected, the operator will normally halt the well stimulation procedure until administrative assistance is obtained to resolve any malfunction. The operator is further assisted in deducing the success of the ball drop by observation of the Follower Position graph 360 and the Drop Snapshot graph 362. As explained above, the Follower Position graph 360 provides the operator with a graphical representation of a movement of the ball stack tracker 158 in real time during a ball drop. The resulting sloped line 518 is drawn by the control console 64 on the Follower Position graph 360 as the frac ball is dropped from the frac ball stack 36 using the follower position data sent by the onboard processor 84, as described above with reference to FIG. 30.

The Drop Snapshot graph is drawn by the control console 64 after the ball drop is completed using the ball drop confirmation data sent by the onboard processor 84 to the control console 64, as also explained above with reference to FIG. 30. The ball drop confirmation data includes: the data values 334-354 described above with reference to FIG. 21, all Follower Position data collected during the ball drop and the Timestamp associated with each Follower Position data item. The Timestamp and the Follower Position data items are used to paint the Drop Snapshot graph which plots Follower Position on the Y-axis vs. time on the X-axis. The resulting graph 520 will clearly show the exact drop point of larger frac balls, though the exact drop point of small frac balls may be less apparent due to side stacking of the ball stack 36 on the ball rail 34.

Figure 33:
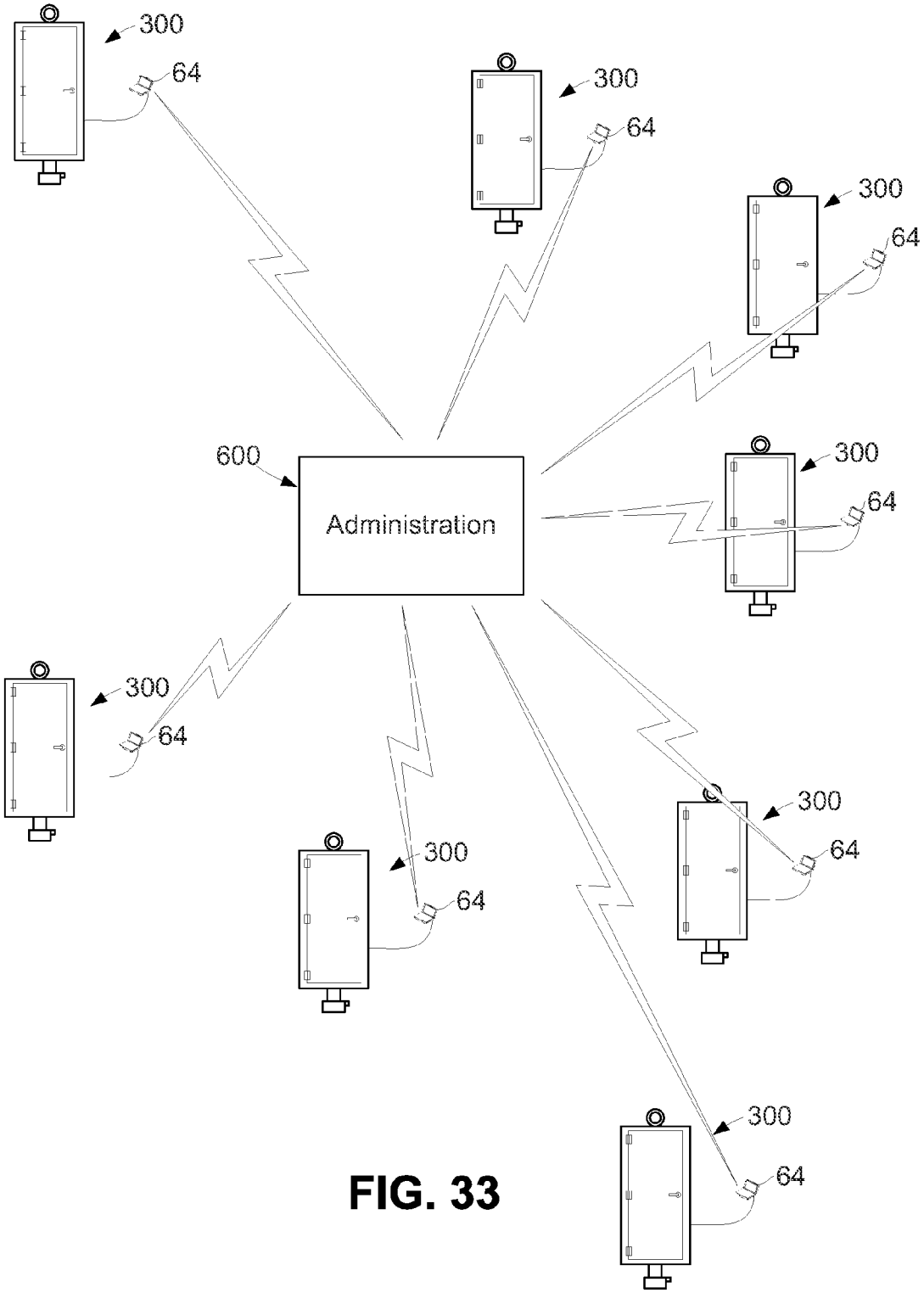
FIG. 33 is a schematic view of a system for monitoring and maintaining the controlled aperture ball drops in accordance with the invention.

FIG. 33 is a schematic view of a system for monitoring and maintaining the controlled aperture ball drops 300 in accordance with the invention. With dozens or hundreds of controlled aperture ball drops 300 operating in a wide geographical area, administration and maintenance becomes a significant task. To enable effective administration and maintenance of those tools, each controlled aperture ball drop 300 is periodically monitored remotely by an administration facility 600 using a remote data communication connection to the control console 64 to determine the number of well stimulation jobs performed; and, when a predetermined time has passed since last maintenance or a predetermined number of well stimulation procedures have been performed, all ball drop data is downloaded by the administration facility 600 for analysis. After analysis of that data, remote adjustment of the Home Position may be performed or onsite maintenance may be scheduled, as will be explained below with reference to FIG. 34.

Figure 34:
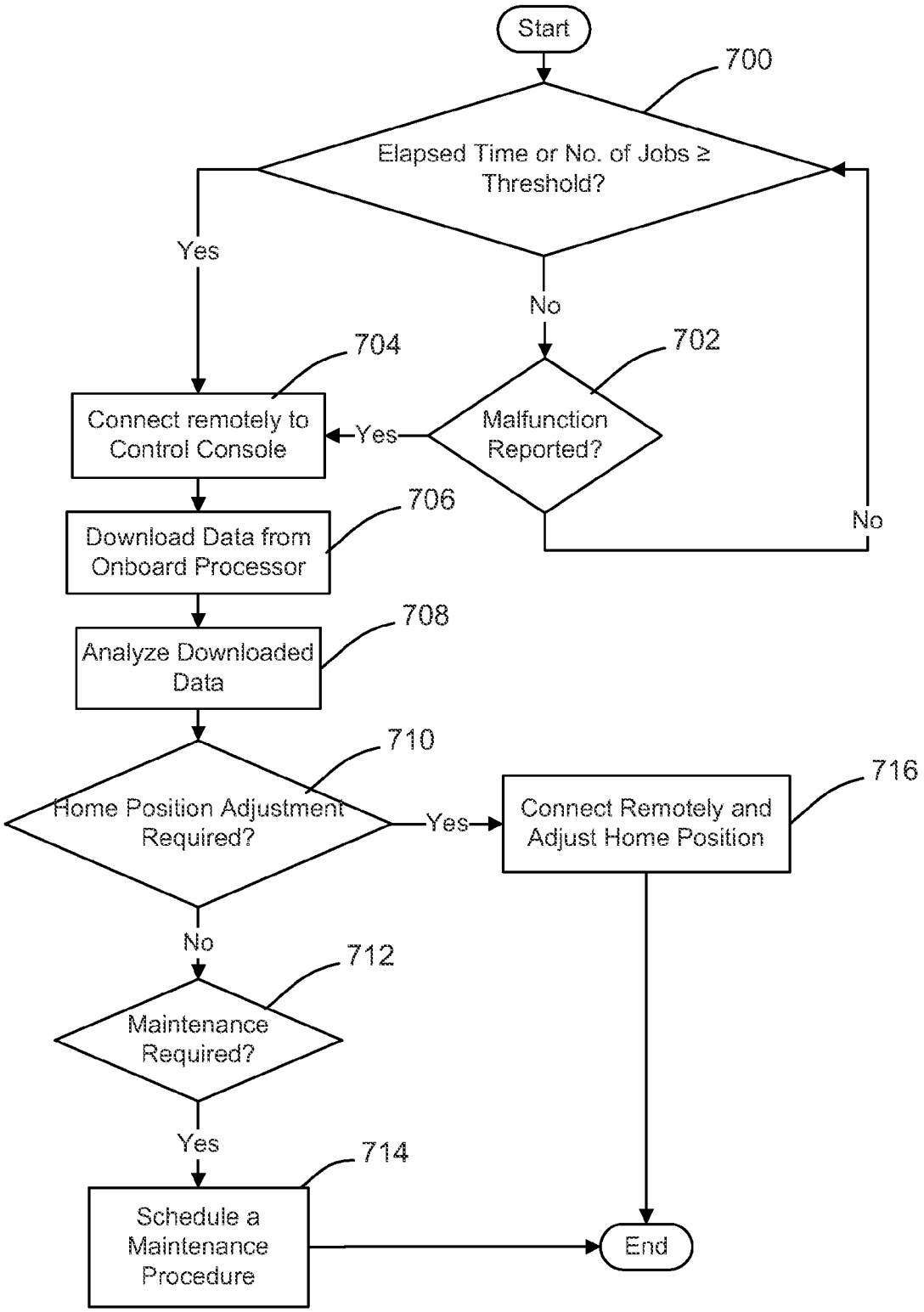
FIG. 34 is a flow chart depicting principal steps performed during scheduled and unscheduled maintenance of the controlled aperture ball drops in accordance with the invention.

FIG. 34 is a flow chart depicting principal steps performed during scheduled and unscheduled maintenance of the controlled aperture ball drops 300. As noted above, it is periodically determined at 700 if an elapsed time since a last data analysis exceeds a threshold or the number of jobs performed since a last data analysis exceeds a threshold. Alternatively, a malfunction may be reported by an operator at 702. When any one of these events occur, the administration facility 600 establishes a virtual communications connection with the control console 64 and downloads 706 all Data Acquisition File records and the Ball Drop Data File records stored by the onboard processor 84. That data is then analyzed to compare actual frac ball drop points with the theoretical frac ball drop points to determine the effects of pressure, vibration and wear on the mechanical integrity of the controlled aperture ball drop 30. Any noticeable migration of drop points is addressed in one of two ways. If the migration is minor and consistent, it can normally be addressed by a Home Position adjustment as determined at 710, and the adjustment is performed remotely at 716 using administration tools that will be described below with reference to FIGS. 35 and 36, and the process ends. If the migration is major or inconsistent, it is determined at 712 that onsite maintenance is required, a maintenance procedure is scheduled 714, and the process ends.

Figure 35:
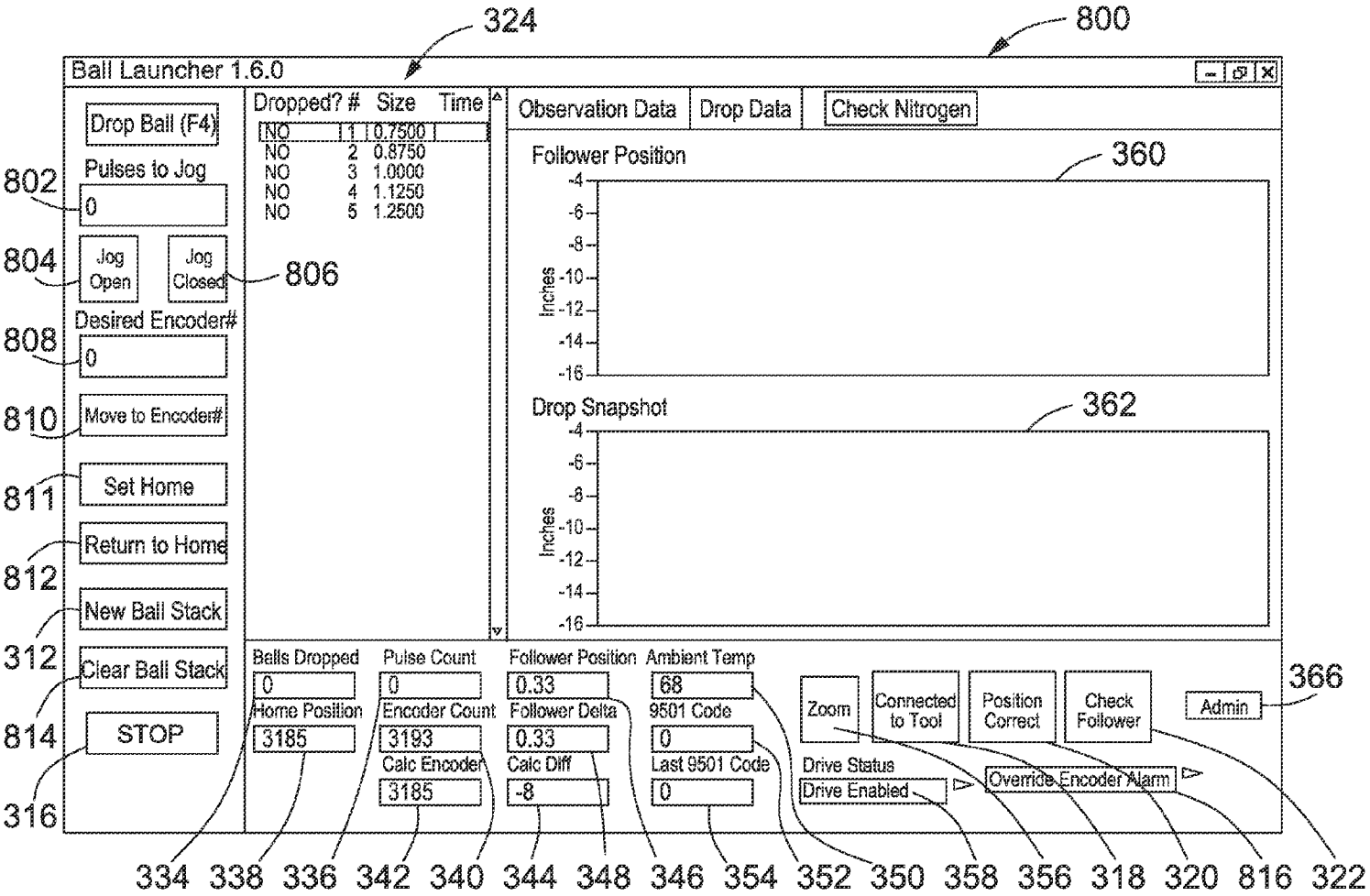
FIG. 35 is a schematic view of an administrator interface for the controlled aperture ball drop in accordance with the invention showing a ball drop observation data tab.

FIG. 35 is a schematic view of an administrator interface 800 for the controlled aperture ball drop in accordance with the invention showing a ball drop observation data tab 801, which displays the same Follower Position graph 360 and Drop Snapshot graph 362 seen by the operator. The administrator interface 800 permits an administrator to take control of the controlled aperture ball drop 30 to perform maintenance procedures or recover from a malfunction. Control may be exercised locally or remotely via a virtual connection established in a manner known in the art. The administrator interface 800 displays all information and functions available to the operator, as well as the following inputs and action buttons used to adjust the Home Position: a "Pulses to Jog" input 802 that permits the administrator to input a whole number representing the number of drive pulses to be sent by the onboard processor 84 to the stepper motor/drive 90 in order to adjust the Home Position; a "Jog Open" button 804 that increases a size of the aperture at the Home Position by the "Pulses to Jog"; a "Jog Closed" button 806 that decreases the size of the aperture at the Home Position by the "Pulses to Jog"; a "Desired Encoder #" input 808 that permits the administrator to input a whole number representing a desired position of the aperture control arm 40 as represented by the Encoder number, which is an alternative to "Pulses to Jog" for adjusting the Home Position; a "Move to Encoder #" button 810, which prompts the control console 64 to instruct the onboard processor 84 to move the aperture control arm 40 inwardly if the "Desired Encoder #" is smaller than the Encoder Count 340, and prompts the control console 64 to instruct the onboard processor 84 to move the aperture control arm 40 outwardly if the "Desired Encoder #" is larger than the Encoder Count 340; and, a "Set Home" button 811, which prompts the control console 64 to instruct the onboard processor to set a current position of the aperture control arm 40 as the Home Position and reset the Pulse Count 336 to zero. As noted above, the Home Position is set so the aperture size will securely retain a 0.750" frac ball. However, the Home Position is not set so that the first pulse count end sum will drive the aperture control arm 40 to an aperture size of 0.750". Because of additives and impurities in frac fluids such as frac sand, etc., a frac ball cannot necessarily be expected to drop from the rail 34 when the size of the aperture corresponds to the diameter of the frac ball being dropped. In order to ensure a drop, Home Position is set so that the first pulse count end sum will drive the aperture control arm 40 to an aperture size that is about 20% greater than the diameter of the first frac ball to be dropped.

A "Clear Ballstack" button 814 is provided to permit the administrator to clear ball stack information from the memory of the onboard processor 84. The "Clear Ballstack" button also removes all ball stack information from the ball stack list 324.

The administrator interface 800 also provides an "Override Encoder Alarm" button 816 that permits the administrator to override an Encoder Alarm. The Encoder Alarm disables the stepper motor/drive 90 if the absolute encoder 102 senses that the aperture control arm 40 is being driven past its normal operational range. This can occur if the control software has an error (bug) in it or if an administrator sets up a 'jog' with the wrong number in the Pulses to Jog 802. The stepper motor/drive 90 is powerful enough to damage to the controlled aperture ball drop 30 if it moves beyond its operational range. Consequently, a field programmable gate array (FPGA) (not shown) is programmed to monitor for 'out of range' operation and to disable the stepper motor/drive 90 when the operational range is breached. However, there are instances when it is advantageous to drive the aperture control arm 40 without a functional absolute encoder 102. If the absolute encoder 102 fails, it outputs a reading of "0". Since this is out of the range of normal operation, the FPGA disables the stepper motor/drive 90. If this happens in the middle of a well stimulation procedure, the Override Encoder Alarm button 816 permits the well stimulation procedure to be finished using the secondary feedback of the Follower Position 360 and Drop Snapshot 362 to confirm ball drops without feedback from the absolute encoder 102.

Figure 36:
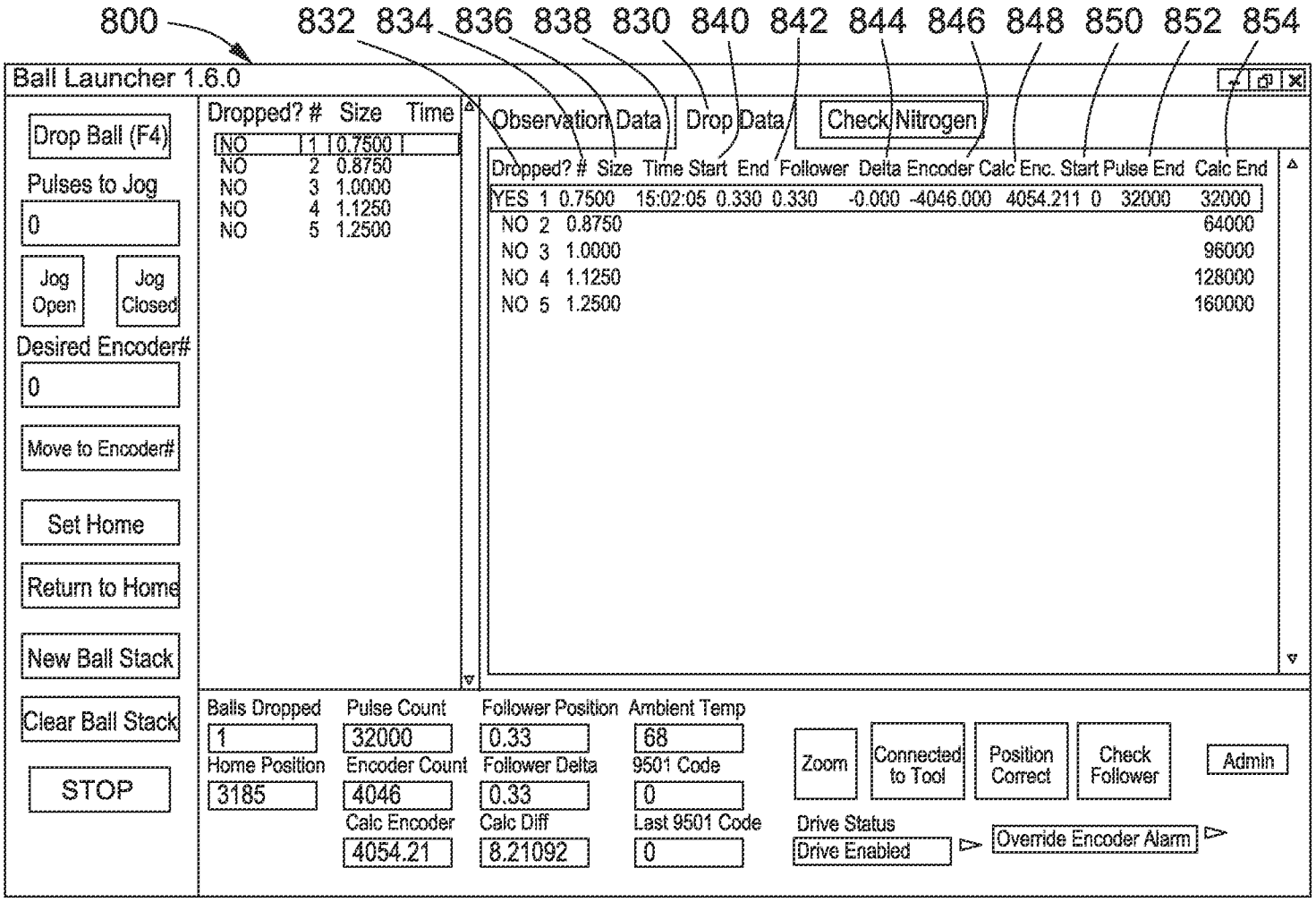
FIG. 36 is a schematic view of the administrator interface for the controlled aperture ball drop in accordance with the invention showing a ball drop data tab.

FIG. 36 is a schematic view of the administrator interface 800 for the controlled aperture ball drop 30 showing a ball drop data tab 830. The ball drop data tab 830 displays information maintained by the control console 64 for each frac ball dropped until a new ball stack is configured. The information displayed includes all of the information displayed on the ball stack list 324, namely: Dropped status (YES/NO) 832; Ball # 834; Ball Size 836 and Time Dropped (dd/mm/yy/hh/mm/ss) 838. Also displayed using data sent to the control console 64 by the onboard processor 84 at 440 (FIG. 30) are the following: start position of the ball stack tracker 158 (Start 840); end position of the ball stack tracker 158 (End Follower 842); change in the position of the ball stack tracker 158 (Delta 844, i.e. End Follower 842 minus Start 840); absolute encoder 102 number (Encoder 846); calculated encoder number (Calc. Enc. 848); pulse count start (Start 850); pulse count end (Pulse End 852); pulse count end sum (Calc. End 854). This information is analyzed by the administrator to determine the cause of a malfunction and/or plan a recovery from the malfunction.

The embodiments of the invention described above are only intended to be exemplary of the controlled aperture ball drop 30*a*-30*i* in accordance with the invention, and not a complete description of every possible configuration. The scope of the invention is therefore intended to be limited solely by the scope of the appended claims.

We claim:

1. A controlled aperture ball drop, comprising:

a ball cartridge adapted to be mounted to a frac head or a high pressure fluid conduit and further adapted to support a frac ball stack arranged in a predetermined size sequence;

an aperture controller adapted to incrementally control a size of an aperture at a bottom end of the frac ball stack to sequentially drop frac balls from the frac ball stack;

a control console that accepts operator input to create a ball stack list arranged in a size sequence from a smallest to a largest frac ball to be dropped by the aperture controller, and further accepts input from the operator to drop a next frac ball in the ball stack list;

an onboard processor that accepts data and commands from the control console to configure the ball stack list and subsequently drop the next frac ball in the ball stack list, and returns data to the control console after each frac ball has been dropped to permit the control console to display data and draw graphs that are displayed to the operator to confirm that each of the respective frac balls has been dropped by the aperture controller.

2. The controlled aperture ball drop as claimed in claim 1 wherein the control console further comprises a user interface having a plurality of action buttons selectable by the operator to permit the operator to perform a plurality of predefined functions; and, a plurality of status indicators that respectively provide feedback to the operator to indicate whether the controlled aperture ball drop is functioning as expected.

3. The controlled aperture ball drop as claimed in claim 1 wherein the onboard processor comprises programmed instructions that are executed uninterruptedly whenever the controlled aperture ball drop is powered on, the programmed instructions periodically writing records to a data acquisition file.

4. The controlled aperture ball drop as claimed in claim 1 wherein the onboard processor comprises programmed instructions that are executed uninterruptedly whenever the onboard processor drives an aperture control arm of the controlled aperture ball drop, the programmed instructions periodically writing records to a ball drop data file.

5. The controlled aperture ball drop as claimed in claim 1 wherein the control console further comprises an administrator interface having a plurality of inputs and action buttons selectable by the administrator to permit the administrator to perform a plurality of predefined functions; and, a plurality of status indicators that respectively provide feedback to the administrator to indicate whether the controlled aperture ball drop is functioning properly.

6. The controlled aperture ball drop as claimed in claim 5 wherein the plurality of inputs and action buttons comprise a pulses to jog input that permits the administrator to input a whole number representing a number of drive pulses to be sent by the onboard processor to a stepper motor/drive in order to adjust a home position of the controlled aperture ball drop; a jog open button that increases a size of an aperture at the home position by the pulses to jog; and, a jog closed button that decreases the size of the aperture at the home position by the pulses to jog.

7. The controlled aperture ball drop as claimed in claim 5 wherein the plurality of inputs and action buttons comprise a desired encoder number input that permits the administrator to input a whole number representing a desired position of an aperture control arm as represented by the desired encoder number; and, a move to encoder number button, which prompts the control console to instruct the onboard processor to move the aperture control arm inwardly if the desired encoder number is smaller than a current encoder count, and prompts the control console to instruct the onboard processor to move the aperture control arm outwardly if the desired encoder number is larger than the current encoder count.

8. The controlled aperture ball drop as claimed in claim 5 wherein the plurality of inputs and action buttons comprise a set home position button, which sets a current position of the aperture control arm as a home position and resets a pulse count to zero.

9. A controlled aperture ball drop, comprising:

a cylinder having a top end sealed by a top cap and a bottom end adapted to be connected to a frac head or a high pressure fluid conduit;

a frac ball support adapted to support a frac ball stack in an ascending size sequence within the cylinder;

a control arm operatively connected to the frac ball support, the control arm being movable to incrementally control a size of a ball drop aperture between an inner periphery of the cylinder and a bottom end of the frac ball support to sequentially drop frac balls from the frac ball stack;

a control console that accepts operator input to create a ball stack list arranged in a size sequence from a smallest to a largest frac ball to be dropped by the control arm, and further accepts input from the operator to drop a next frac ball in the ball stack list after the ball stack list has been created;

an onboard processor mounted to the cylinder, the onboard processor accepting data and commands from the control console to configure the ball stack list and subsequently drop the next frac ball in the ball stack list, and returning data to the control console after each frac ball has been dropped to permit the control console to display data and draw graphs that are displayed to the operator to confirm that each of the respective frac balls has been dropped by the aperture controller; and a control/power umbilical used to transmit the data and commands from the control console to the onboard processor, and receive the data sent from the onboard processor to the control console.

10. The controlled aperture ball drop as claimed in claim 9 wherein the operator console further comprises a user interface having a plurality of action buttons selectable by the operator to permit the operator to initiate a plurality of predefined functions executed by the onboard processor; and, a plurality of status indicators that respectively provide feedback to the operator to indicate whether the data sent from the onboard processor indicates that the controlled aperture ball drop functioned as expected.

11. The controlled aperture ball drop as claimed in claim 9 wherein the onboard processor comprises programmed instructions that are executed uninterruptedly whenever the controlled aperture ball drop is connected to the control console and powered on, the programmed instructions periodically writing records to a data acquisition file.

12. The controlled aperture ball drop as claimed in claim 9 wherein the onboard processor comprises programmed instructions that are executed uninterruptedly while the onboard processor drives an aperture control arm of the controlled aperture ball drop to drop a next frac ball, the programmed instructions periodically writing records to a ball drop data file.

13. The controlled aperture ball drop as claimed in claim 9 wherein the operator console further comprises an administrator interface having a plurality of inputs and action buttons selectable by an administrator to permit the administrator to perform a plurality of predefined functions to be executed by the onboard processor; and, a plurality of status indicators that respectively provide feedback to the administrator using the data sent from the onboard processor to indicate to the administrator whether the controlled aperture ball drop is functioning as instructed.

14. The controlled aperture ball drop as claimed in claim 13 wherein the plurality of inputs and action buttons comprise pulses to jog input that permits the administrator to input a whole number representing a number of drive pulses to be sent by the onboard processor to a stepper motor/drive of the controlled aperture ball drop in order to adjust a home position of a ball rail of the controlled aperture ball drop; a jog open button that increases a size of an aperture at the home position by the pulses to jog; and, a jog closed button that decreases the size of the aperture at the home position by the pulses to jog.

15. The controlled aperture ball drop as claimed in claim 13 wherein the plurality of inputs and action buttons comprise a desired encoder number input that permits the administrator to input a whole number representing a desired position of an aperture control arm as represented by the desired encoder number; and, a move to encoder number button, which prompts the control console to instruct the onboard processor to move the aperture control arm from a current encoder count to the desired encoder number.

16. The controlled aperture ball drop as claimed in claim 13 wherein the plurality of inputs and action buttons comprise a set home position button, which instructs the onboard processor to set a current position of the aperture control arm as the home position and reset a current pulse count to zero.

17. A controlled aperture ball drop, comprising:

a frac ball support that supports a frac ball stack arranged in a predetermined size sequence within a cylinder having a sealable top end;

an aperture controller operatively connected to the frac ball support, the aperture controller incrementally controlling a size of an aperture between a bottom end of the frac ball support and an inner periphery of the cylinder to sequentially drop the frac balls from the frac ball stack;

a control console having an operator interface that accepts operator input to create a new ball stack list of frac balls to be dropped by the aperture controller, listing the frac balls arranged in a size sequence from a smallest to a largest frac ball to be dropped, and further accepts input from the operator to drop a next frac ball in the ball stack list after the ball stack list has been created;

an onboard processor mounted to the cylinder, the onboard processor accepting control signals from the control console to configure the new ball stack list and subsequently drop the next frac ball in the ball stack list, and returning data to the control console after each frac ball drop command has been received to permit the control console to display data and draw graphs that are indicative of whether the frac ball drop was successful; and a control/power umbilical used to transmit the control signals from the control console to the onboard processor, and transmit status information from the onboard processor to the control console.

18. The controlled aperture ball drop as claimed in claim 17 wherein the user interface comprises a plurality of action buttons selectable by the operator to permit the operator to initiate a plurality of predefined functions to be executed by the onboard processor; and, a plurality of status indicators that respectively provide feedback to the operator to indicate whether the status information sent from the onboard processor indicates that the controlled aperture ball drop functioned as expected.

19. The controlled aperture ball drop as claimed in claim 17 wherein the onboard processor comprises first programmed instructions that are executed uninterruptedly whenever the controlled aperture ball drop is connected to the control console and powered on, the first programmed instructions periodically writing records to a data acquisition file, and second programmed instructions that are executed uninterruptedly while the onboard processor drives an aperture control arm of the controlled aperture ball drop to drop a next frac ball, the second programmed instructions periodically writing records to a ball drop data file.

20. The controlled aperture ball drop as claimed in claim 17 wherein the operator interface further comprises an administrator interface accessible by an administrator of the controlled aperture ball drop, the administrator interface accepting a plurality of inputs and having a plurality of action buttons selectable by the administrator to permit the administrator to initiate a plurality of predefined functions to be executed by the onboard processor; and, a plurality of status indicators that respectively provide feedback to the administrator in response to the status information sent from the onboard processor to indicate to the administrator whether the controlled aperture ball drop is functioning as instructed.

* * * * *